US005082766A

United States Patent [19]

Nishijima et al.

[11] Patent Number: 5,082,766

[45] Date of Patent: Jan. 21, 1992

[54] SILVER HALIDE COLOR PHOTOGRAPHIC LIGHT-SENSITIVE MATERIAL

[75] Inventors: Toyoki Nishijima, Odawara; Masaki Tanji, Odawara; Noboru Mizukura, Tokyo; Shuichi Sugita, both of Tokyo, all of Japan

[73] Assignee: Konica Corporation, Tokyo, Japan

[21] Appl. No.: 517,361

[22] Filed: May 1, 1990

[30] Foreign Application Priority Data

May 8, 1989 [JP] Japan ..... 1-115860
Dec. 6, 1989 [JP] Japan ..... 1-317060

[51] Int. Cl.[5] ..... G03C 1/34; G03C 7/38
[52] U.S. Cl. ..... 430/551; 430/558
[58] Field of Search ..... 430/558, 551

[56] References Cited

U.S. PATENT DOCUMENTS 4,639,415 1/1987 Kaneko et al. ..... 430/558
4,665,015 5/1987 Iijima et al. ..... 430/558
4,933,271 6/1990 Rody et al. ..... 430/551

FOREIGN PATENT DOCUMENTS 0183445 6/1986 European Pat. Off. ..... 430/558

*Primary Examiner*—Charles L. Bowers, Jr.
*Assistant Examiner*—Lee C. Wright
*Attorney, Agent, or Firm*—Jordan B. Bierman

[57] ABSTRACT

A silver halide color photographic light-sensitive material is disclosed. The light-sensitive material comprises a greensen-sitive silver halide emulsion layer which contains a coupound represented by the following formula T and a magenta coupler represented by the following formula M-I:

Formula T

Formula M-I in formula T, $R_1$ and $R_2$ each is a hydrogen atom or an alkyl group; $R_3$ and $R_4$ each is a hydrogen atom, an alkyl group, an aryl group or a heterocyclic group; $R_5$ and $R_6$ each is a hydrogen atom, an alkyl group, an aryl group, an acyl group or an alkoxycarbonyl group; X is a divalent group including a carbon atom as the component of the 6-member ring of formula T; and n is an integer of zero, 1 or 2. In formula M-I, Z is a group of non-metal atoms necessary to form a nitrogen-containing heterocyclic ring; Xs is a hydrogen atom or a splitting off substitutent; and $R_9$, $R_{10}$ and $R_{11}$ each is a hydrogen atom or a substituent provided that two or three groups represented by $R_9$ to $R_{11}$ are not hydrogen atoms at the same time. The light-sensitive material is improved in the light fastness of magenta image and prevented in formation of yellow stain in no image formed area.

14 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material, and more particularly to a silver halide color photographic light-sensitive material capable of forming a dye image which is stable against heat and light and prevented from staining.

BACKGROUND OF THE INVENTION

It is well-known that when an imagewise exposed silver halide color photographic light-sensitive material is processed in a color developer, the coupling reaction therein of a coupler with the oxidation product of an aromatic primary amine color developing agent produces a dye such as indophenol, indoaniline, indamine, azomethin, phenoxazine or phenazine to thereby form a dye image.

In such the photographic process, a subtractive color reproduction method is usually employed, in which there is used a silver halide color photographic material having blue-sensitive, green-sensitive and red-sensitive silver halide emulsion layers containing couplers having complementary color relations therewith. i.e., yellow, magenta and cyan color-forming couplers, respectively.

As the above yellow color image forming coupler there are acylacetanilide-type couplers: as the magenta color image forming coupler there are known pyrazolone, pyrazolobenzimidazole, pyrazolotriazole and indazolone-type couplers: and as the cyan color image forming coupler, there are generally used phenol and naphthol-type couplers.

The dye image thus obtained is requested not to fade or discolor even when exposed to light and stored under a high temperature/moisture condition over a long period of time. The non-dye-image-formed area of a silver halide photographic light-sensitive material (hereinafter called a color light-sensitive material) is requested to produce no yellow stain (hereinafter called Y-stain) attributable to light or heat/moisture.

In the case of the magenta coupler, however, it often comes into question that it produces much more Y-stain due to light or heat/moisure on the non-dye-image-formed area and discoloration due to light on the dye image area than do yellow and cyan couplers.

Couplers widely used for forming magenta dyes are 5-pyrazolone compounds. The dye formed from such the 5-pyrazolone compound has a subabsorption near 430 nm in addition to its principal absorption near 550 nm, which is a serious problem. In order to solve this problem, various studies have been made to date. Magenta couplers of the type of 5-pyrazolones having an anilino group in the third position thereof are useful particularly for making color image prints because the above-mentioned subabsorption thereof is small. These techniques are described in U.S. Pat. No. 2,343,703 and British Patent No. 1,059,994.

The above magenta coupler, however, has the disadvantage that a dye image formed therefrom has not only a poor image preservability. i.e., fastness against light, but also a significant Y-stain in its non-dye-image-formed area.

As other means to reduce the subabsorption near 430 nm of the above magenta couplers there have been proporsed the use of those magenta couplers such as the pyrazolobenzimidazoles described in British Patent No. 1,047,612; the indazolones described in U.S. Pat. No. 3,770,447; the 1H-pyrazolo[5,1-c]-1,2,4-triazole couplers described in U.S. Pat. No. 3,725,067, British Patent Nos. 1,252,418 and 1,334,515; the 1H-pyrazolo[1,5-b]-1,2,4-triazole couplers described in Research Disclosure 24531 (1984): the 1H-pyrazolo[1,5-c]-1,2,3-triazole couplers described in Research Disclosure 24626 (1984): the lH-imidazoI,2-b]pyrazole couplers described in Japanese Patent O.P.I. Publication No. 162548/1984 and Research Disclosure 24531: the 1H-pyrazolo[1,5-]pyrazole couplers described in Research Disclosure 24230 (1984); and the 1H-pyrazolo[1,5-d]tetrazole couplers described in Research Disclosure 24220 (1984). Of these magenta couplers, the dyes formed from the 1H-pyrazolo[5,1-c]-1,2,4-triazole couplers, 1H-pyrazolo[1,5-b]pyrazole couplers and 1H-pyrazolo[1,5-d]tetrazole couplers are suitable for color reproduction since their absorption near 430 nm is significantly smaller than that of the dyes formed from 5-pyrazolones having an anilino group in the third position thereof, and advantageous because they produce very little Y-stain caused by light and heat/moisture in the non-dye-image-formed area.

However, the fastness to light of the azomethine dyes formed from these couplers is significantly low, and the dyes are liable to be discolored by light, so that they, when used, will impair the characteristics of light-sensitive materials. particularly color light-sensitive materials for making color prints.

Japanese Patent O.P.I. Publication No. 125732/1984 proposes a technique for improving the light fastness of a magenta dye image obtained from the 1H-pyrazolo[5,1-c]-1,2,4-triazole magenta coupler by using a phenol-type compound or a phenylether-type compound in combination therewith.

Even the above technique, however, is insufficient to prevent the above magenta dye image from light fading. and it is almost impossible for the technique to prevent the dye image from discoloration.

SUMMARY OF THE INVENTION

It is a first object of the present invention to provide a color photographic light-sensitive material capable of forming a magenta dye image having an excellent color reproducibility and a markedly improved light fastness.

It is a second object of the invention to provide a color photographic light-sensitive material capable of forming a magenta dye image which is little discolored by light.

It is a third object of the invention to provide a color photographic light-sensitive material capable of forming an image of which the non-dye-image-formed area is prevented from producing a Y-stain.

The above objects of the invention are accomplished by a silver halide color photographic light-sensitive material which comprises a support having thereon at least one green-sensitive silver halide emulsion layer containing a compound represented by the following Formula T and a magent coupler represented by the following Formula M-1:

Formula T

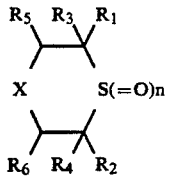

wherein $R_1$ and $R_2$ each represents a hydrogen atom or an alkyl group; $R_3$ and $R_4$ each represents a hydrogen atom, an alkyl group, an aryl group or a heterocyclic group; $R_5$ and $R_6$ each is a hydrogen atom. an alkyl group. an aryl group. an acyl group or an alkoxycarbonyl group; X is a divalent group having carbon atoms as the component atoms constituting the above 6-member cyclic ring; and n is an integer of zero, 1 or 2, Formula M-I

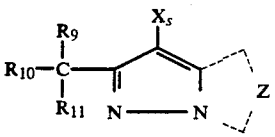

wherein z is a group of non-metallic atoms necessary to form a nitrogen-containing heterocyclic ring, provided that the ring formed by Z may have a substituent: $X_s$ is a hydrogen atom or a group capable of splitting off upon reaction with the oxidation product of a color developing agent:$R_9$, $R_{10}$ and $R_{11}$ each is a hydrogen atom or a substituent. provided that two or three of them are not hydrogen atoms at the same time.

DETAILED DESCRIPTION OF THE INVENTION

The compound represented by Formula T is detailed below:

The alkyl group represented by $R_1$ or $R_2$ is preferably a methyl group.

The alkyl group represented by $R_3$ and $R_6$ is preferably one having 1 to 4 carbon atoms, and the aryl group represented by the same is preferably a phenyl group.

The heterocyclic group represented by $R_3$ or $R_4$ is preferably a thienyl group.

The alkoxycarbonyl group represented by $R_5$ or $R_6$ is preferably one having 2 to 19 carbon atoms, and the acyl group represented by the same is preferably an acetyl or benzoyl group.

The groups represented by $R_3$ through $R_6$ include those having a substituent. Where $R_3$ or $R_4$ is a phenyl group, examples of the substituent thereto include a halogen atom, an alkyl group having 1 to 8 carbon atoms, a phenyl group, a cyclohexyl group. an alkoxy group having 1 to 18 carbon atoms, a phenyl-alkyl group having 7 to 9 carbon atoms, and a hydroxyl group. Where $R_5$ or $R_6$ is an alkyl group. examples of the substituent thereto include a hydroxyl group. a phenyl group, an alkoxy group having 1 to 12 carbon atoms, a benzoyloxy group, and an alkylcarbonyloxy group having 2 to 18 carbon atoms.

The divalent group represented by X is preferably —CO—,

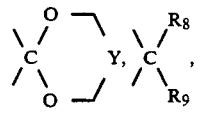

>C=N—NH—R′ group, wherein R′ is an acyl group; $R_7$ is a hydrogen atom, an alkyl group having 1 to 4 carbon atoms, or $—CH_2OR_{10}$; is an only linkage or

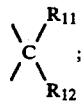

$R_8$ is a hydrogen atom, a methyl group, a phenyl group,

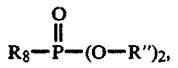

in which R″ is an alkyl having 1 to 4 carbon atoms, an aryloxy group, a benzyloxy group, a carbamoyl group or an alkoxy group having 1 to 12 carbon atoms; $R_9$ is a hydrogen atom, a hydroxyl group, an aryloxy group, benzyloxy group, an alkOxy group having 1 to 12 carbon atoms, an acyloxy group or an acylamino group; $R_{10}$ is a hydrogen atom or an acyl group; $R_{11}$ is a hydrogen atom, an alkyl group having 1 to 4 carbon atoms or $—CH_3OR_{14}$; $R_{12}$ is a hydrogen atom or an alkyl group having 1 to 4 carbon atoms; and $R_{14}$ is a hydrogen atom or an acyl group; and $R_3$ and $R_9$ may be bonded to form a ring.

Useful examples of the acyl group in the acyloxy or acylamino group represented by $R_9$, the acyl group represented by $R_{10}$ or $R_{14}$, and the acyl group R in the >C=N—NH—R′ group represented by X include a benzoyl group. an alkylcarbonyl group having 2 to 18 carbon atoms,

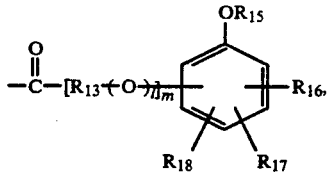

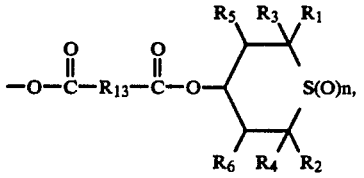

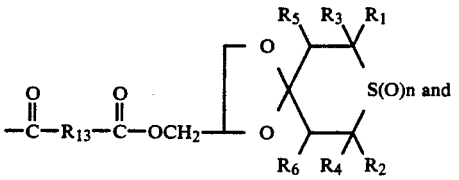

-continued

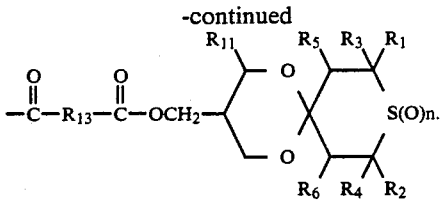

In the above formulas, $R_1$ to $R_6$, $R_{11}$ and n are as defined previously; l and m each is an integer of zero or 1, provided that m is equal to or larger than l; $R_{13}$ is an only linkage or a divalent linkage group such as an alkylene group having 1 to 14 carbon atoms or a

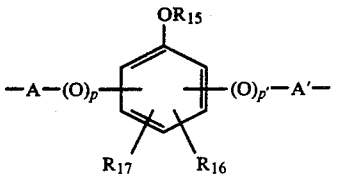

group, wherein A and A' each is an alkylene group and p and p' each is an integer of zero or 1; $R_{15}$ is a hydrogen atom an alkyl group preferably having 1 to 8 carbon atoms, an acyl group, an alkoxyoxalyl group, a sulfonyl group or a carbamoyl group; $R_{16}$ and $R_{17}$ each is a hydrogen atom. an alkyl group or an aryl group; $R_{18}$ is a hydrogen atom, —$OR_{15}$ or

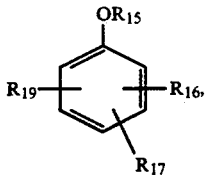

wherein $R_{15}$, $R_{16}$ and $R_{17}$ are as defined previously: and $R_{19}$ is —O—, —S—. —S—S— or

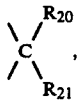

$R_{20}$ and $R_{21}$ each is a hydrogen atom or an alkyl group.

The following are examples of the compounds represented by Formula T:

T-1

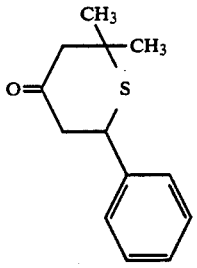

T-2

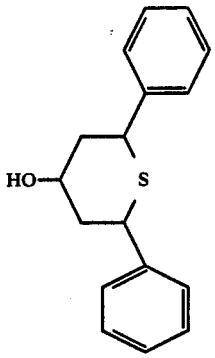

T-3

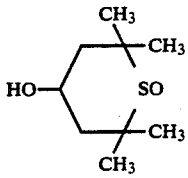

-continued
T-4
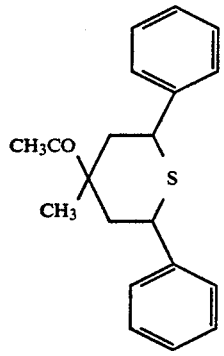
T-5
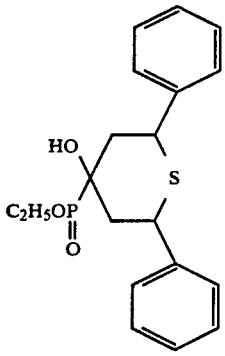
T-6
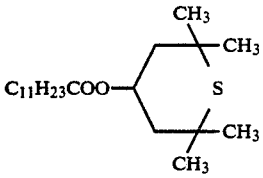
T-7
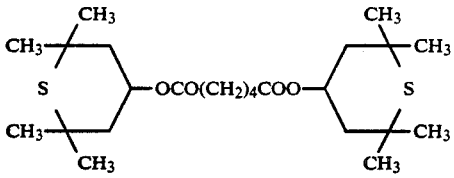
T-8
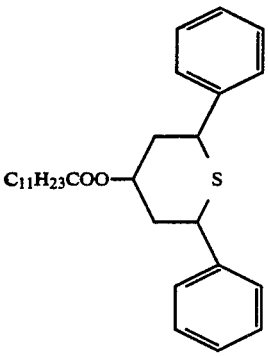

-continued
T-9
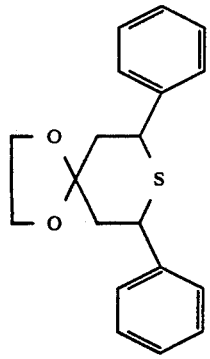
T-10
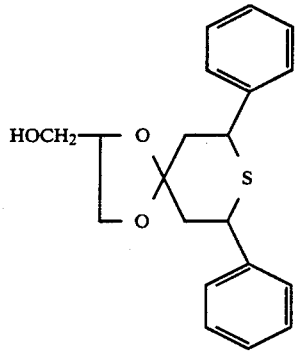
T-11
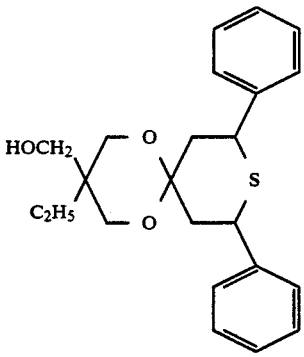
T-12
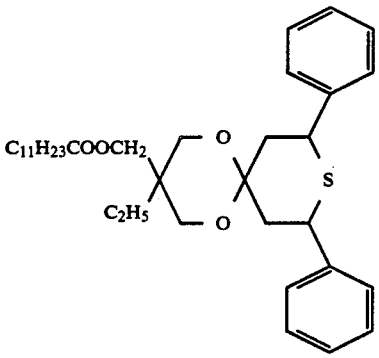
T-13
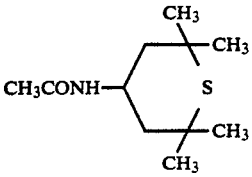

-continued
T-14
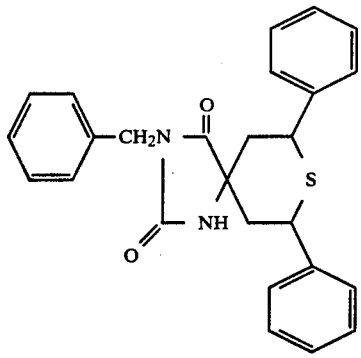
T-15
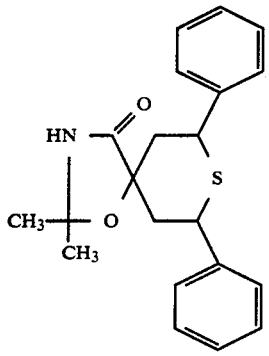
T-16
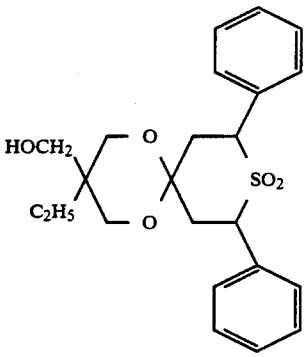
T-17
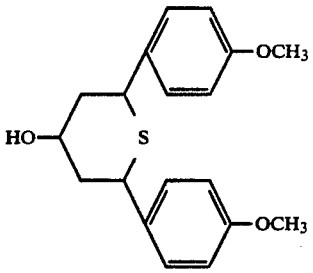
T-18
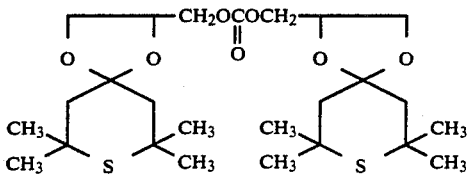

-continued
T-19
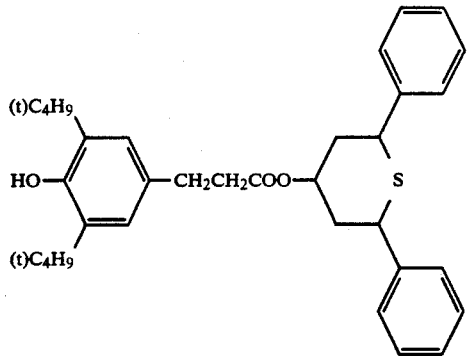
T-20
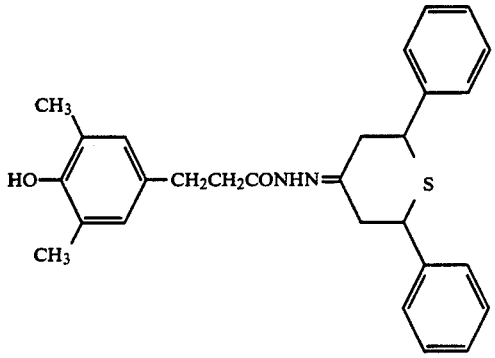
T-21
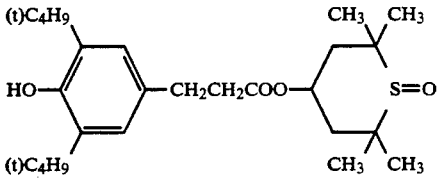
T-22
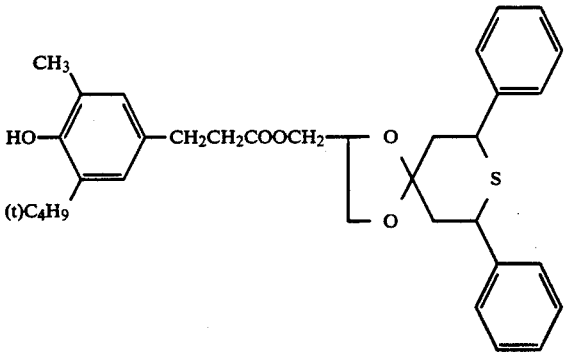
T-23
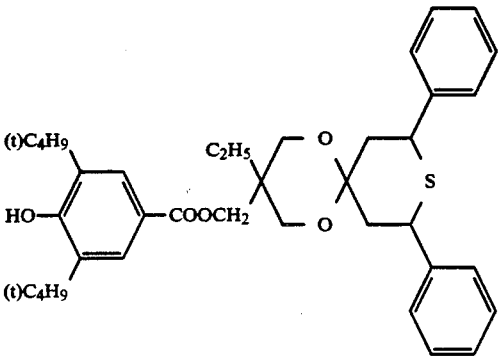

-continued
T-24
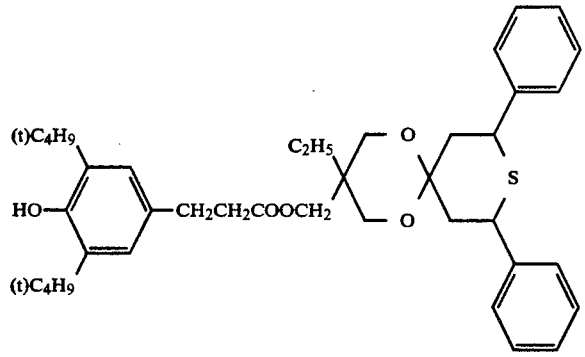
T-25
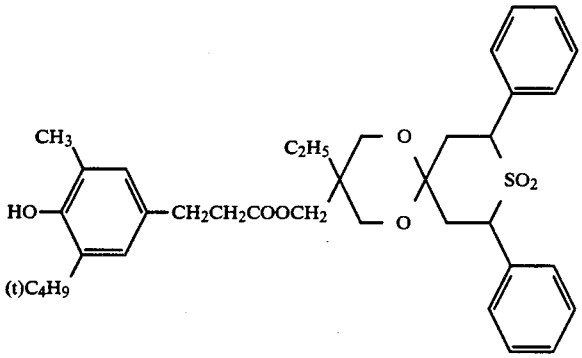
T-26
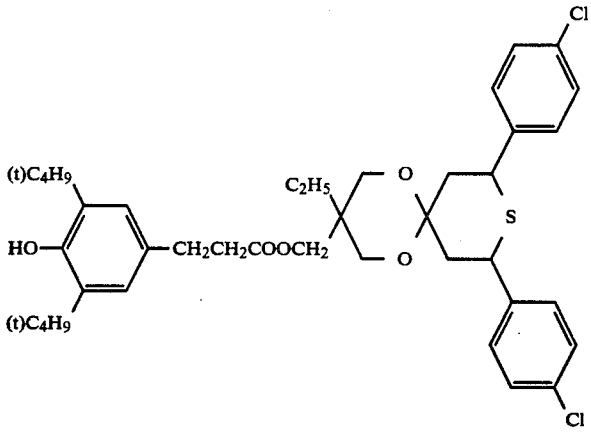
T-27
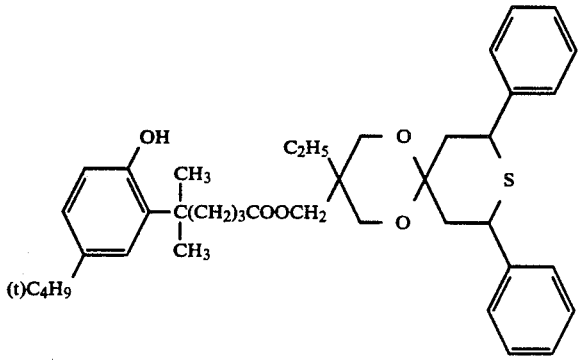

-continued
T-28
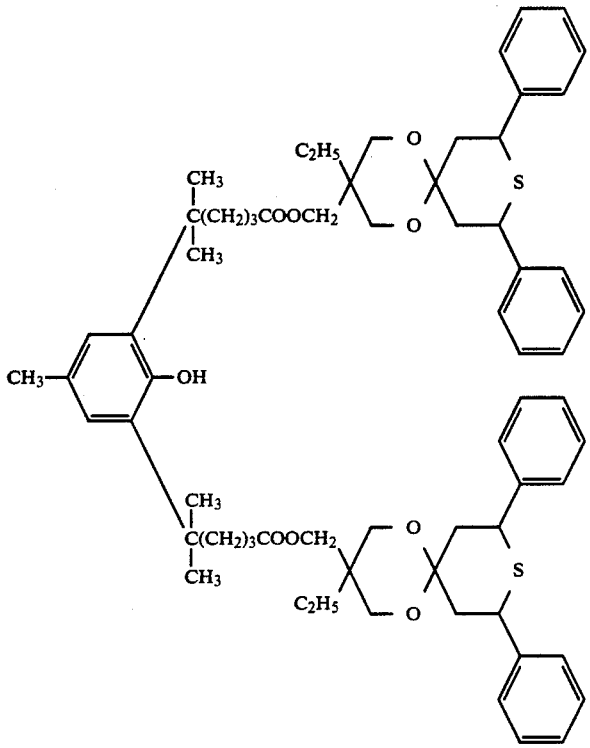
T-29
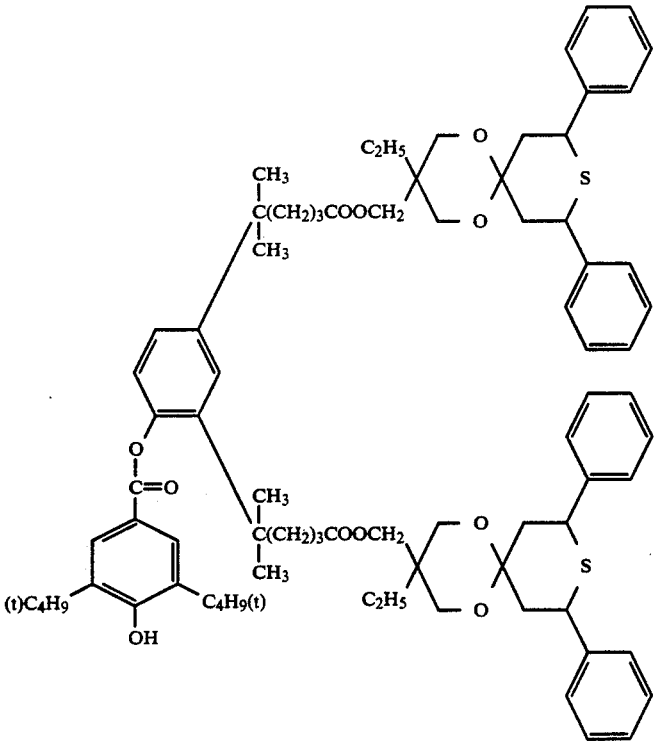

-continued

T-30

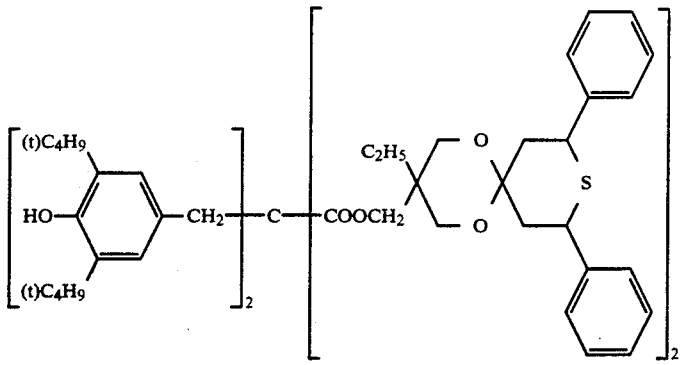

T-31

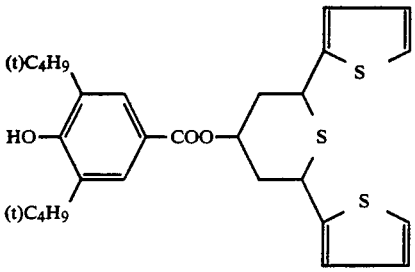

These compounds having Formula T may be synthesized in accordance with known methods such as, for example, a method for acylating a 4-hydroxytetrahydrothiopyrane compound with an acid chloride, and a method for producing a 1,5-dioxa-9-thiaspiro[5,5]-undecane compound or 1,4-dioxa-8-thia-spiro[4,5]-decane compound by the reaction of a 4-ketotetrahydrothiopyrane compound with a diol.

The compound of Formula T is added together with a magenta coupler to a green-sensitive silver halide emulsion layer. The addition of the compound may be carried out preferably in accordance with one of those methods described in U.S. Pat. Nos. 2,322,027, 2,801,170, 2,801,171, 2,272,191 and 2,304,940, which is such that a solution of the compound dissolved in a high-boiling solvent, if necessary. in combination with a low-boiling solvent. is dispersedly added to a hydrophilic colloid solution. and in this instance, if necessary, couplers, a hydroquinone derivative, a UV absorbing agent. a known dye image-antifading agent and the like may also be added. Examples of the known antifading agent include those compounds as described in Japanese Patent O.P.I. Publication No. 143754/1986. In the addition, the compound of the invention may be used in a mixture of two or more kinds thereof.

The adding amount of the compound of Formula T is preferably not more than 1.5 g, and more preferably 0.01 to 0.6g per In Formula M-I, the ring represented by Z may have a substituent, which is hereinafter referred to as $R_0$. The substituent, $R_0$, although not particularly restricted, is typically an alkyl, aryl, anilino, acylamino, sulfonamido, alkylthio, arylthio, alkenyl or cycloalkyl group. but may also be a halogen atom or a cycloalkenyl, alkynyl, heterocyclic, sulfonyl, sulfinyl, phosphonyl, acyl, carbamoyl, sulfamoyl, cyano, alkoxy, aryloxy, heterocyclic oxy, siloxy, acyloxy, carbamoyloxy. amino, alkylamino, imido, ureido. sulfamoylamino. alkoxycarbonylamino, aryloxycarbonylamino, alkoxycarbonyl, aryloxycarbonyl or heterocyclic thio group, or a spiro compound or bridged hydrocarbon residue.

The alkyl group represented by $R_0$ is preferably a straight-chain or branched-chain alkyl group having 1 to 32 carbon atoms.

The aryl group represented by $R_0$ is preferably a phenyl group.

The acylamino group represented by $R_0$ is an alkylcarbonylamino or arylcarbonylamino group.

The sulfonamido group represented by $R_0$ is an alkylsulfonylamino or arylsulfonylamino group.

The alkyl and aryl components in the alkylthio and arylthio groups represented by $R_0$ include the same alkyl and aryl groups as defined for the above $R_0$.

The alkenyl group represented by $R_0$ is a straight-chain or branched-chain alkenyl group having 2 to 32 carbon atoms, and the cycloalkyl group represented by the same is one having 3 to 12 carbon atoms, preferably 5 to 7 carbon atoms.

The cycloalkenyl group represented by $R_0$ is one having 3 to 12 carbon atoms, preferably 5 to 7 carbon atoms.

The sulfonyl group represented by $R_0$ is an alkylsulfonyl or arylsulfonyl group.

The sulfinyl group represented by $R_0$ is an alkylsulfinyl or arylsulfinyl group.

The phosphonyl group represented by $R_0$ is an alkylphosphonyl, alkoxyphosphonyl, aryloxyphosphonyl or arylphosphonyl.

The acyl group represented by $R_0$ is an alkylcarbonyl or arylcarbonyl group.

The carbamoyl group represented by $R_0$ is an alkylcarbamoyl or arylcarbamoyl group.

The sulfamoyl group represented by $R_0$ is an alkylsulfamoyl or arylsulfamoyl group.

The acyloxy group represented by $R_0$ is an alkylcarbonyloxy or arylcarbonyloxy group.

The carbamoyloxy group represented by $R_0$ is an alkylcarbamoyloxy or arylcarbamoyloxy group.

The ureido group represented by $R_0$ is an alkylureido or arylureido group.

The sulfamoylamino group represented by $R_0$ is an alkylsulfamoylamino or arylsulfamoyl group.

The heterocyclic group represented by $R_0$ is preferably a 5- to 7-member heterocyclic group such as a 2-furyl, 2-thienyl. 2-pyrimidinyl or 2-benzothiazolyl group.

The heterocyclic oxy group represented by $R_0$ is preferably one having a 5- to 7-member heterocyclic ring, such as a 3,4,5,6-tetrahydropyranyl-2-oxy or I-phenyltetrazole-5-oxy group.

The heterocyclic thio group represented by $R_0$ is preferably a 5- to 7-member heterocyclic thio group such as a 2-pyridylthio, 2-benzothiazolylthio or 2,4-diphenoxy-1,3,5-triazole-6-thio group.

The siloxy group represented by $R_0$ is a trimethylsiloxy. triethylsiloxy or dimethylbutylsiloxy group.

The imido group represented by $R_0$ is a succinic acid imido, 3-heptadecylsuccinic acid imido, phthalimido or glutarimido group.

The spiro compound residue represented by $R_0$ is a spiro[3.3]heptane-1-yl group.

The bridged hydrocarbon compound residue represented by $R_0$ is a bicyclo[2.2.1]heptane-1-yl, tricyclo[3.3.1.1]decane-1-yl or 7,7-dimethyl-bicyclo[2.2.1-]heptane-1-yl group.

The group represented by Xs.which is capable of splitting off upon the reaction of the oxidation product of a color developing agent, is a halogen atom such as chlorine, bromine or fluorine, or an alkoxy, aryloxy, heterocyclic oxy, acyloxy, sulfonyloxy, alkoxycarbonyloxy, aryloxycarbonyl, alkyloxalyloxy, alkoxyoxalyloxy, alkylthio, arylthio, heterocyclic thio, alkyloxythiocarbonylthio, acylamino, sulfonamido, N atom-bonded nitrogen-containing heterocyclic, alkyloxycarbonylamino, aryloxycarbonylamino, carboxyl or the following group;

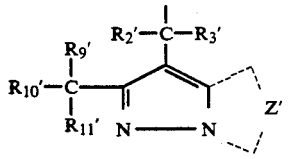

wherein $R_9'$, $R_{10}'$ and $R_{11}'$ are as defined for $R_9$, $R_{10}$ and $R_{11}$, respectively: Z' is the same as the above Z; $R_2$ and $R_3'$ each is a hydrogen atom, an aryl group, an alkyl group or a heterocyclic group. Preferred among the above groups is the halogen atom, particularly chlorine.

The nitrogen-containing heterocyclic group formed by Z or Z' is preferably a pyrazol, imidazole, triazole or tetrazole ring.

The compounds represented by Formula M-I, more particularly, include those represented by M-II through M-VII.

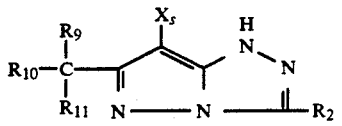

Formula M-II

-continued

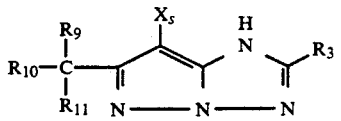

Formula M-III

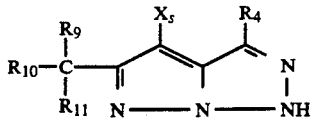

Formula M-IV

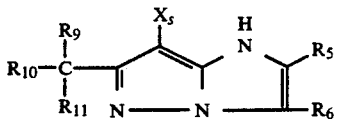

Formula M-V

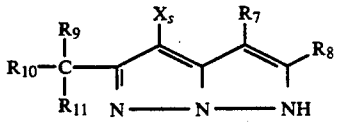

Formula M-VI

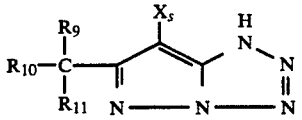

Formula M-VII

In Formulas M-II through M-VII, R, is the same as the foregoing R, and $R_2$ to $R_8$ and $X_5$ are as defined for the foregoing $R_0$ and $X_5$, respectively.

Preferred among the compounds represented by Formula M-I are those represented by the following Formula M-VIII.

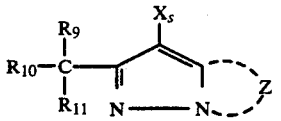

Formula M-VIII wherein $R_9$, $R_{10}$, $R_{11}$, X and $Z_1$ are as defined for the $R_9$, $R_{10}$, $R_{11}$, $X_5$ and Z, respectively, in Formula M-I.

As previously mentionedd, in Formulas M-I to M-VIII, $R_9$, $R_{10}$ and $R_{11}$ each is a hydrogen atom or a substituent, provided that two or three of them are not hydrogen atoms at the same time.

The most preferred as the substituent represented by $R_9$, $R_{10}$ or $R_{11}$ is an alkyl group.

Two out of the above $R_9$, $R_{10}$ and $R_{11}$, e.g., $R_9$ and $R_{10}$, may combine with each other to form a saturated or unsaturated ring such as a cycloalkane, cycloalkene or heterocyclic ring. and further, $R_{11}$ may also link to the ring to form a bridged hydrocarbon compound residue.

Preferred among the substituents represented by

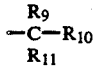

are those in which (i) at least two out of $R_9$ to $R_{11}$ are alkyl groups. and (ii) one of $R_9$ to $R_{11}$, e.g., $R_{11}$, is a hydrogen atom, and the other two, $R_9$ and $R_{10}$, combine with each other to form together with the immediate carbon atom a cycloalkyl group.

Also preferred among the substituents of (i) are those in which two out of $R_9$ to $R_{11}$ are alkyl groups and the other one is a hydrogen atom or an alkyl group.

Preferred as the substituents which may be owned by the ring formed by Z in Formula M-I and $Z_1$ in Formula M-VIII and as the $R_2$ to $R_8$ of Formulas M-II through M-VI are those represented by the following Formula M-X:

$$-R_{12}-SO_2-R_{13} \qquad \text{Formula M-X}$$

wherein $R_{12}$ is an alkylene group; $R_{13}$ is an alkyl, cycloalkyl or aryl group.

The alkylene group represented by $R_{12}$ is a straight-chain or branched-chain alkylene group of which the straight-chain part has preferably two or more carbon atoms, and more preferably 3 to 6 carbon atoms.

The cycloalkyl group represented by $R_{13}$ is preferably a 5- or 6-member one.

The following are examples of the magenta couplers represented by Formula M-I.

M-1

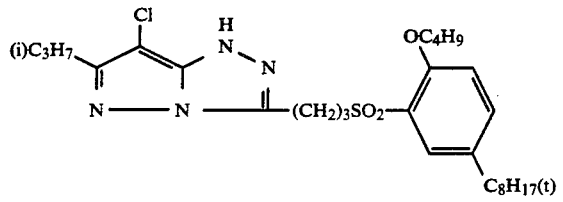

M-2

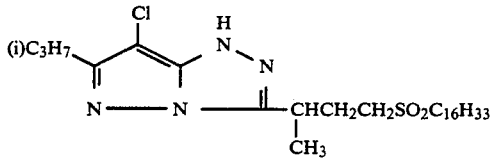

M-3

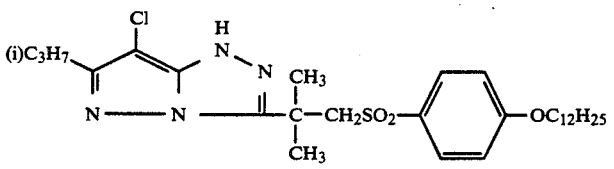

M-4

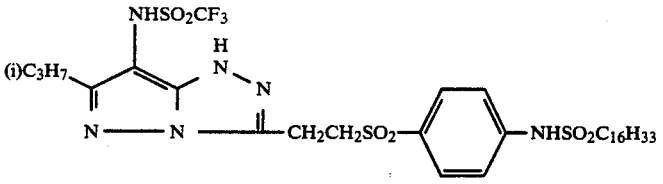

M-5

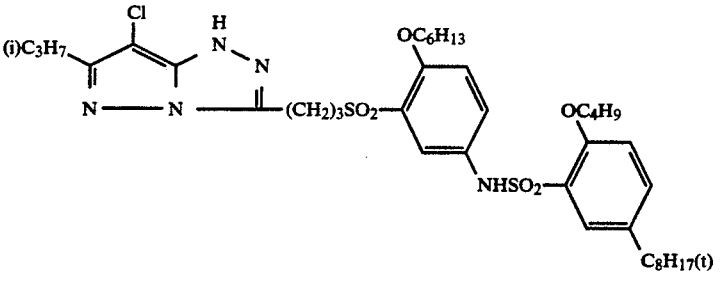

M-6

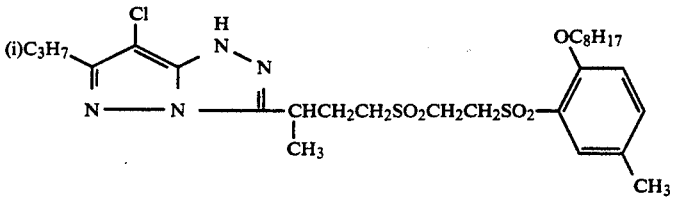

-continued
M-7
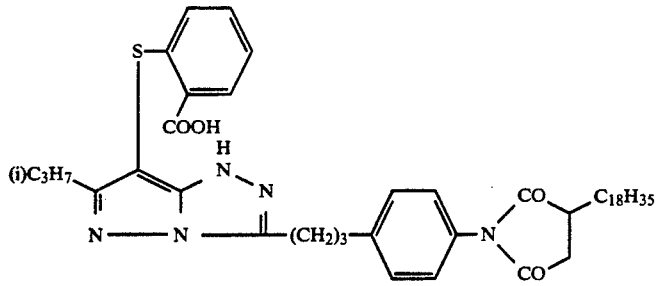
M-8
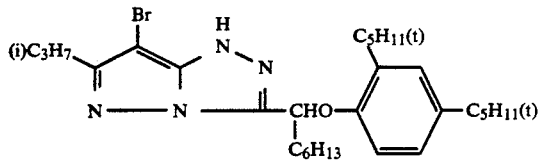
M-9
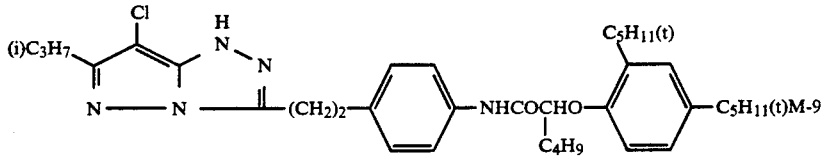
M-10
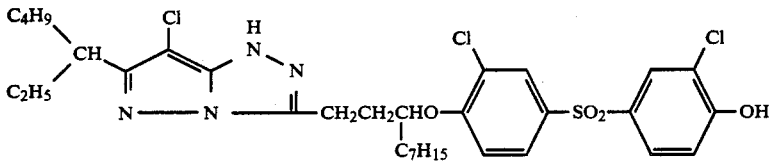
M-11
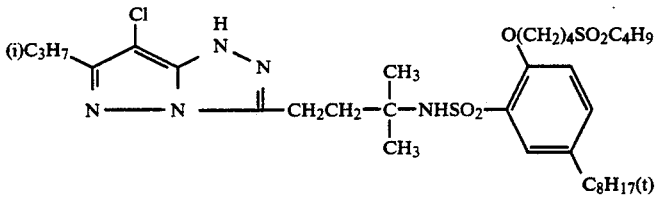
M-12
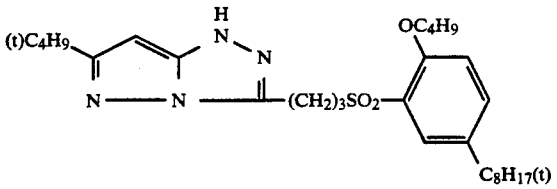
M-13
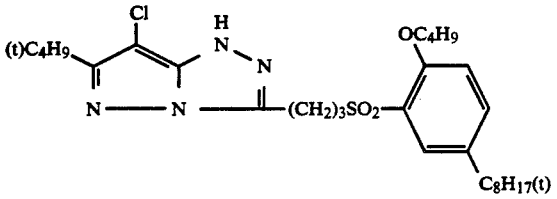
M-14
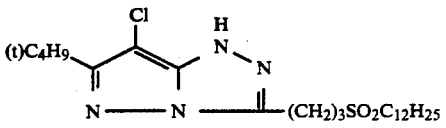
M-15
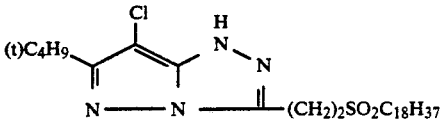

-continued
M-16
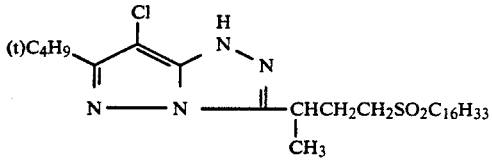
M-17
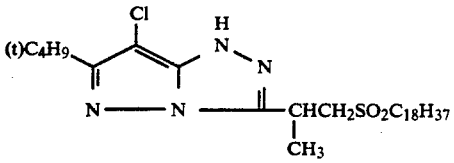
M-18
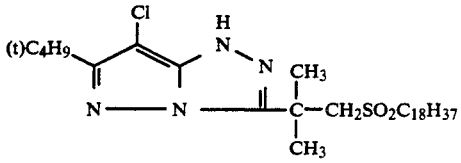
M-19
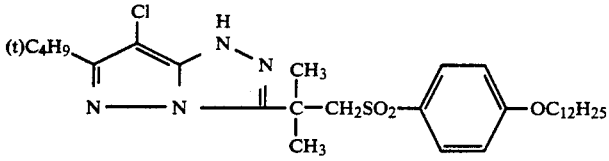
M-20
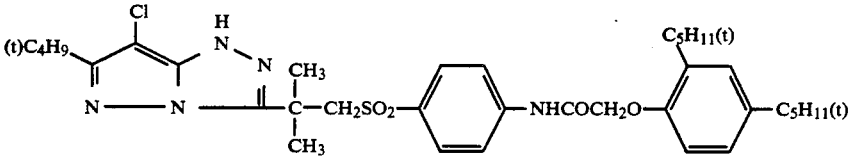
M-21
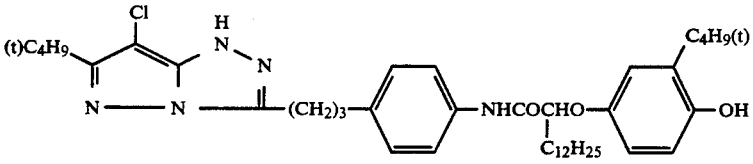
M-22
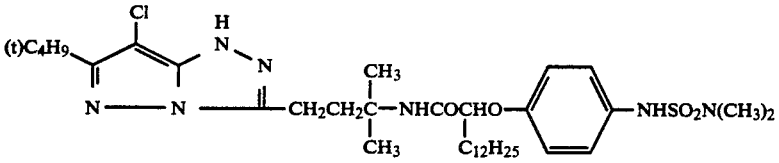
M-23
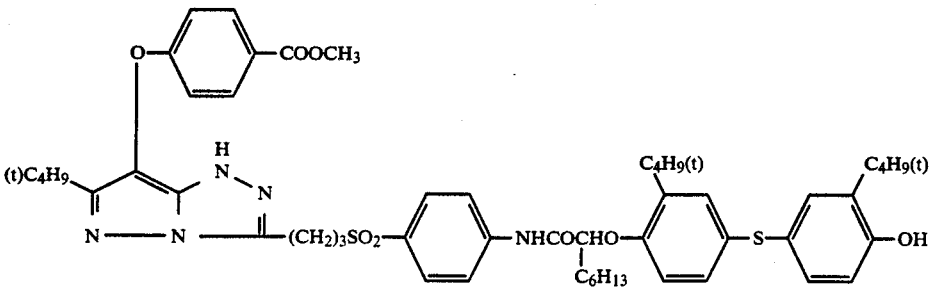

-continued
M-24
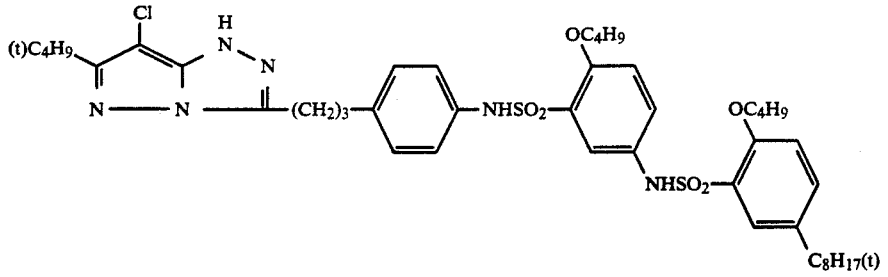
M-25
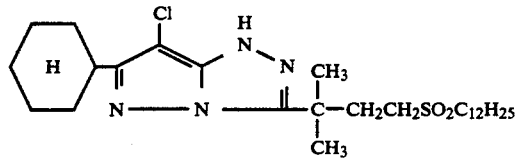
M-26
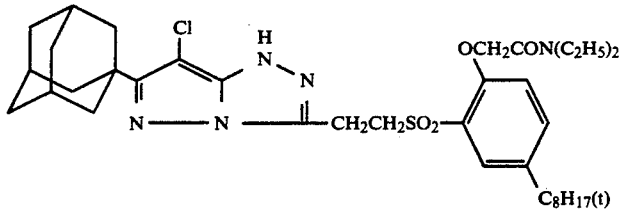
M-27
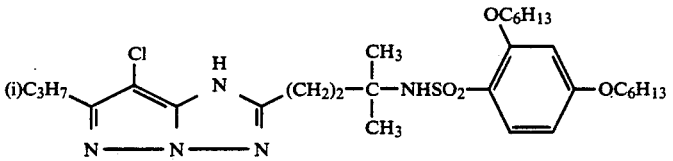
M-28
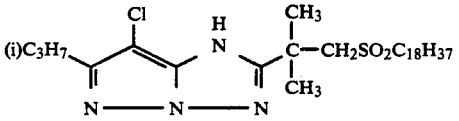
M-29
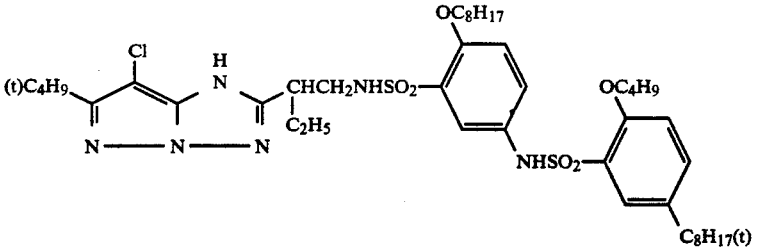
M-30
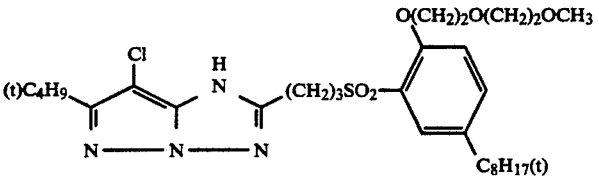
M-31
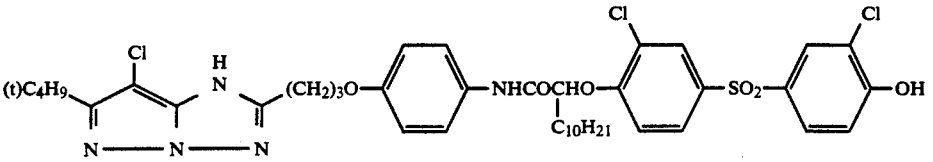

-continued
M-32
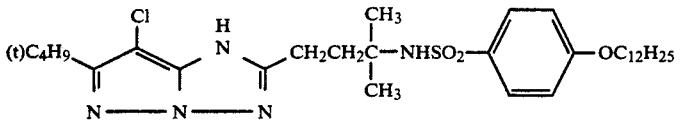
M-33
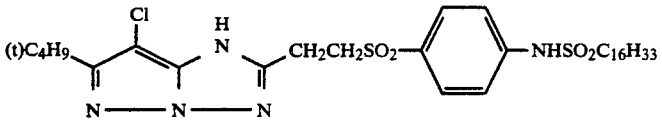
M-34
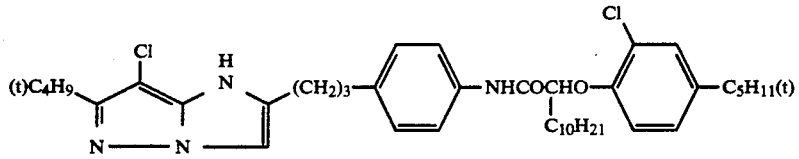
M-35
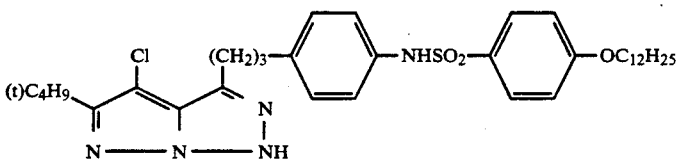
M-36
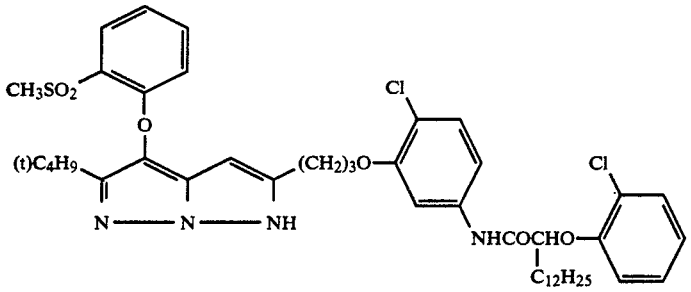
M-37
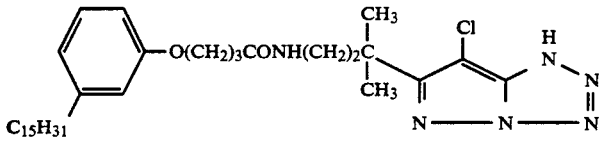
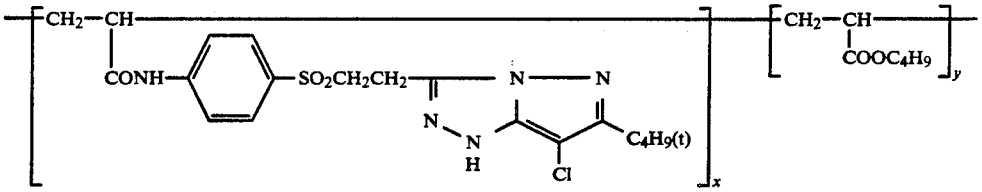
M-38
x:y = 50:50 (ratio by weight)
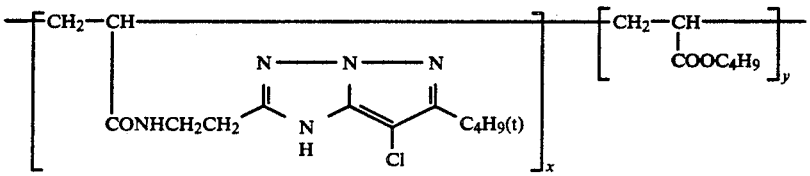
M-39
x:y = 50:50 (ratio by weight)
The above couplers may be synthesized by making reference to the Journal of the Chemical Society, Perkin, I (1977), 2047 to 2052; U.S. Pat. No. 2,725,067;

Japanese Patent O.P.I. Publication Nos. 99437/1984, 42045/1983, 162548/1984, 171956/1984, 33552/1985, 43659/1985, 172982/1985 and 190779/1985.

The coupler of the inVention may be used in the amount range of normally $1\times10^{-3}$ mole to 1 mole, and preferably $1\times10^{-2}$ mole to $8\times10^{-1}$ mole per mole of silver halide.

The coupler of the invention may be used in combination with different magenta couplers.

The high-boiling solvent for use in dispersing the coupler is an organic solvent having a boiling point of not lower than 150° C. Usable types of the solvent are not particularly restricted and include esters such as phthalates. phosphates and maleates: phosphine oxide compounds, organic acid amides, ketones, and hydrocarbon compounds.

Among these high-boiling solvents. preferred are those having a dielectric constant at 30° C. of not more than 6.0, more preferred are those having a dielectric constant of from 1.9 to 6.0 and a vapor pressure at 100° C. of not more than 0.5 mmHg, and the most preferred are phthalates, phosphates and phosphine oxide compounds.

The high-boiling organic solvent may be used in a mixture of two or more kinds thereof.

The phthalate advantageously applicable to the invention is a compound having the following Formula S-1:

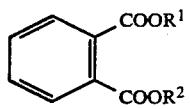

Formula S-1 wherein $R^1$ and $R^2$ each represents an alkyl group, an alkenyl group or an aryl group, provided that the total number of carbon atoms of the groups represented by $R^1$ and $R^2$ is 12 to 32, preferably 16 to 24, and more preferably 18 to 24.

In the invention, the alkyl group represented by $R^1$ or $R^2$ of Formula S-1 may be a straight-chain or branched-chain alkyl group such as a butyl, pentyl, hexyl, 2-ethylhexyl, 3,5,5-trimethylhexyl, octyl, nonyl, decyl, dodecyl, tetradecyl, hexadecyl or octadecyl group. The aryl group represented by $R^1$ or $R^2$ is a phenyl or napthyl group. The alkenyl group is a hexenyl, heptenyl or octadecenyl group. These alkyl, alkenyl and aryl groups include those having a single substituent or a plurality of substituents: examples of substituent to the alkyl and alkenyl groups include halogen atoms and alkoxy, aryl, aryloxy, alkenyl and alkoxycarbonyl groups, and examples of the substituent to the aryl group include halogen atoms and alkyl, alkoxy, aryl, aryloxy, alkenyl and alkoxycarbonyl groups.

In the above, $R^1$ and $R^2$ are preferably alkyl groups such as 2-ethylhexyl, 3,5,5-trimethylhexyl, n-octyl and n-nonyl groups.

The phosphate advantageously usable in the invention is one having the following Formula S-2:

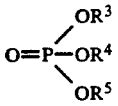

Formula S-2 wherein $R^3$, $R^4$ and $R^5$ each is an alkyl group, an alkenyl group or an aryl group. provided that the total number of carbon atoms of the groups represented by $R^3$, $R^4$ and $R^5$ is 24 to 54, and more preferably 27 to 36.

The alkyl group represented by $R^3$, $R^4$ or $R^5$ is preferably a butyl, pentyl, hexyl, 2-ethylhexyl, heptyl, nonyl, decyl, dodecyl, tetradecyl, hexadecyl, octadecyl or nonadecyl group; the aryl group represented by the same is a phenyl or naphthyl group; and the alkenyl group represented by the same is preferably a hexenyl, heptenyl or octadecenyl group.

These alkyl, alkenyl and aryl groups include those having a single substituent or a plurality of substituents. Preferably, $R^3$, $R^4$ and $R^5$ are alkyl groups such as 2-ethylhexyl, n-octyl 3,5,5-trimethylhexyl, n-nonyl, n-decyl, sec-decyl, sec-dodecyl and t-octyl groups.

The following are typical examples of the high-boiling organic solvent suitably applicable to the invention, but the invention is not limited by the examples.

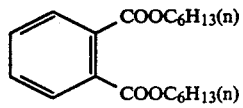

S-1

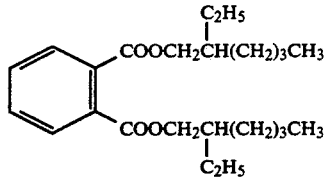

S-2

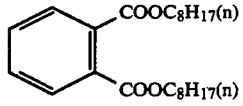

S-3

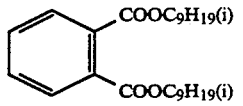

S-4

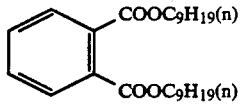

S-5

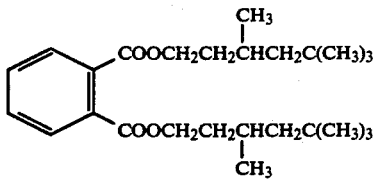

S-6

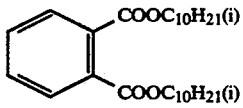

S-7

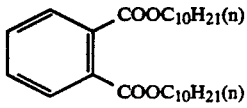

S-8

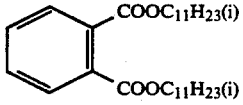

S-9

-continued

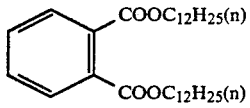

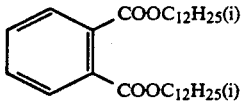

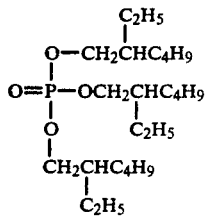

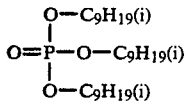

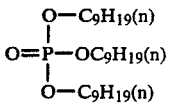

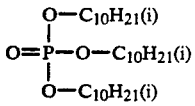

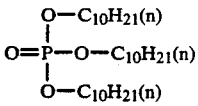

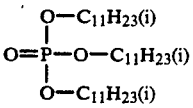

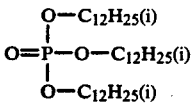

S-10

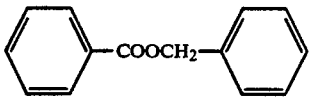

S-11

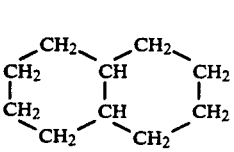

S-12

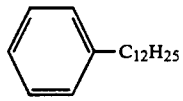

S-22

Further, phosphine oxide compounds having the following Formula TO may also be advantageously used as the high-boiling organic solvent of the invention.

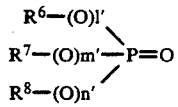

Formula TO wherein $R^6$, $R^7$ and $R^8$ each is an alkyl or aryl group; and l', m' and n' each is an integer of zero or 1, provided that l', m' and n' do not represent 1 at the same time.

S-13 The alkyl group represented by $R^6$, $R^7$ or $R^8$ is a straight-chain, branched-chain or cyclic alkyl group which may have a substituent.

S-14 The unsubstituted alkyl group is an alkyl group having 1 to 20 carbon atoms, preferably 1 to 18 carbon atoms. such as an ethyl, butyl, pentyl, cyclohexyl, octyl, dodecyl, heptadecyl or octadecyl group.

S-15 The substituent in the substituted alkyl group is an aryl, alkoxy, alkoxycarbonyl, aryloxycarbonyl, carbamoyl or sulfamoyl group.

S-16 The aryl group represented by $R^6$, $R^7$ or $R^8$ of Formula TO is a phenyl or naphthyl group which may have a substituent such as an alkyl group having 1 to 18 carbon atoms, preferably 1 to 12 carbon atoms: an alkoxy group having 1 to 12 carbon atoms: an amino group substituted by one or two alkyl groups each having 1 to 12 carbon atoms: an amino group substituted by an acyl group having to 12 carbon atoms; a halogen atom, a hydroxy group, or an amino group.

S-17 The following are examples of the compound having Formula TO used in the invention, but the invention is not limited by the examples.

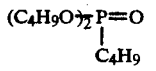

(TO-1)

S-18

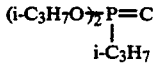

(TO-2)

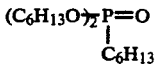

(TO-3)

S-19

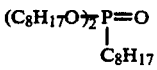

(TO-4)

S-20

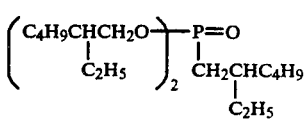

(TO-5)

S-21

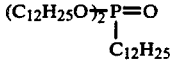

(TO-6)

-continued
(TO-7) $(C_{16}H_{33}O)_2P(=O)C_{16}H_{33}$
(TO-8) $(CH_3O)_2P(=O)C_8H_{17}$
(TO-9) $(CH_3O)_2P(=O)C_{12}H_{25}$
(TO-10) $(C_2H_5O)_2P(=O)C_5H_{11}$
(TO-11) $(C_2H_5O)_2P(=O)C_{12}H_{25}$
(TO-12) $(C_2H_5O)_2P(=O)CH_2CH(C_2H_5)C_4H_9$
(TO-13) $(C_2H_5O)_2P(=O)i\text{-}C_{10}H_{21}$
(TO-14) $(C_2H_5O)_2P(=O)C_{16}H_{33}$
(TO-15) $(C_2H_5O)_2P(=O)C_{17}H_{33}$
(TO-16) $(C_4H_9O)_2P(=O)C_6H_{13}$
(TO-17) $(C_4H_9O)_2P(=O)C_8H_{17}$
(TO-18) $(C_4H_9O)_2P(=O)C_{12}H_{25}$
(TO-19) $(C_4H_9O)_2P(=O)C_{14}H_{29}$
(TO-20) $(C_6H_{13}O)_2P(=O)i\text{-}C_3H_7$
(TO-21) $(C_6H_{13}O)_2P(=O)CH_2CH(C_2H_5)C_4H_9$
(TO-22) $(C_4H_9CH(C_2H_5)CH_2O)_2P(=O)C_4H_9$
(TO-23) $[(CH_3)_3CCH_2CH(CH_3)CH_2CH_2O)]_2P(=O)C_4H_9$
-continued
(TO-24)
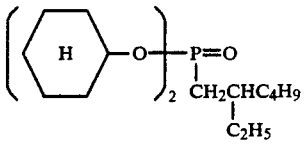
(TO-25)
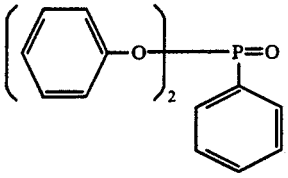
(TO-26)
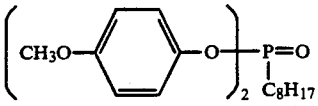
(TO-27)
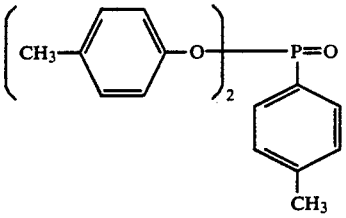
(TO-28)
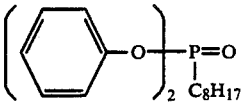
(TO-29)
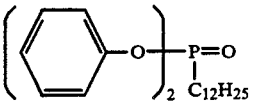
(TO-30)
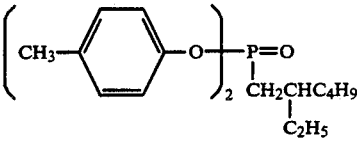
(TO-31)
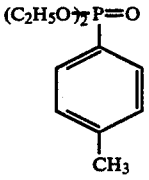
(TO-32)
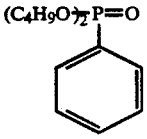
(TO-33)
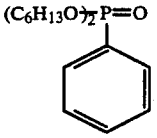

-continued
(TO-34)
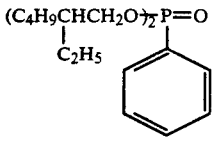
(TO-35)
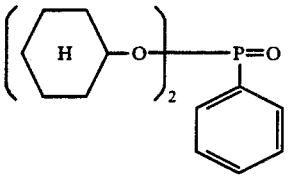
(TO-36)
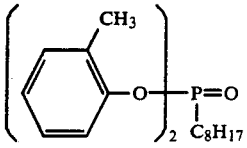
(TO-37)
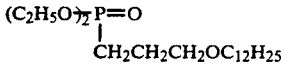
(TO-38)
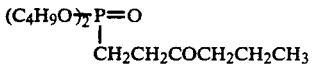
(TO-39)
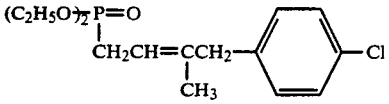
(TO-40)
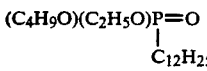
(TO-41)
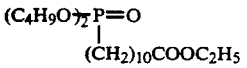
(TO-42)
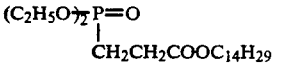
(TO-43)
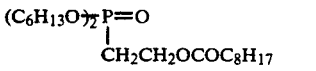
(TO-44)
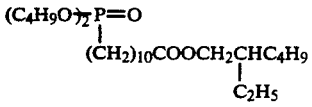
(TO-45)
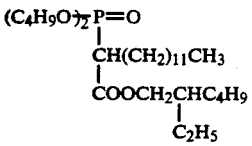
(TO-46)
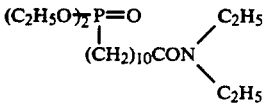
(TO-47)
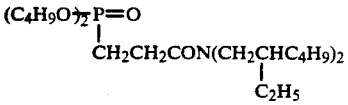
-continued
(TO-48)
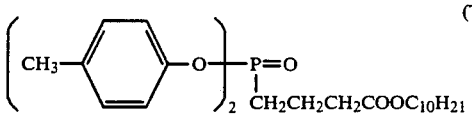
(TO-49)
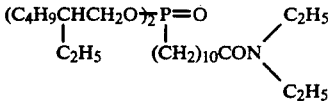
(TO-50)
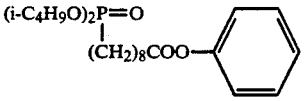
(TO-51)
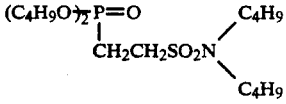
(TO-52)
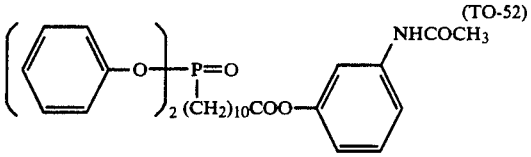
(TO-53)
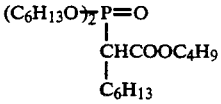
(TO-54)
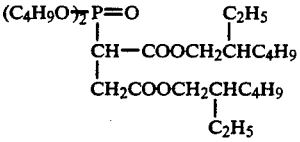
(TO-55)
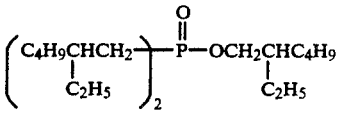
(TO-56)
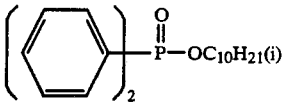
(TO-57)
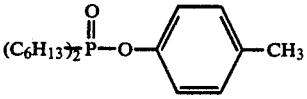
(TO-58)
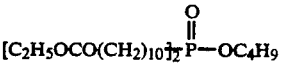
(TO-59)
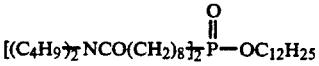
(TO-60)
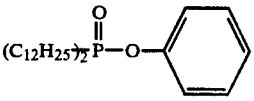
(TO-61)
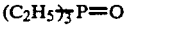

-continued (TO-62) $(C_4H_9)_3P{=}O$ (TO-63) $(i\text{-}C_4H_9)_3P{=}O$ (TO-64) $(C_5H_{11})_3P{=}O$ (TO-65) $(C_6H_{13})_3P{=}O$ (TO-66) $(C_8H_{17})_3P{=}O$ (TO-67) $(C_4H_9CH(C_2H_5)CH_2)_3P{=}O$ (TO-68) $[(CH_3)_3CCH_2CH(CH_3)CH_2CH_2]_3P{=}O$ (TO-69) $(C_{10}H_{21})_3P{=}O$ (TO-70) $(i\text{-}C_{10}H_{21})_3P{=}O$ (TO-71) $(C_{12}H_{25})_3P{=}O$ (TO-72) $(C_{14}H_{29})_3P{=}O$ (TO-73) $(C_{17}H_{33})_3P{=}O$ (TO-74) 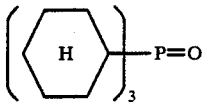

(TO-75) 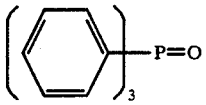

(TO-76) 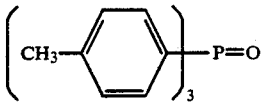

(TO-77) 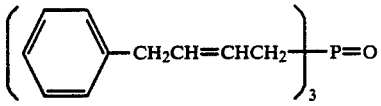

(TO-78) 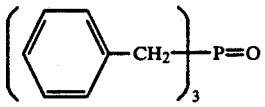

(TO-79) $[C_4H_9OCO(CH_2)_{10}]_3P{=}O$ (TO-80) $[(C_2H_5)_2NCO(CH_2)_{10}]_3P{=}O$ (TO-81) 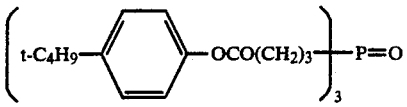

(TO-82) $(C_2H_5)_2\overset{O}{\overset{\|}{P}}{-}C_{12}H_{25}$

-continued (TO-83) $(C_4H_9)_2\overset{O}{\overset{\|}{P}}{-}CH_2CH_2COOCH_2CH(C_2H_5)C_4H_9$ (TO-84) 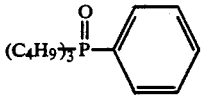

(TO-85) 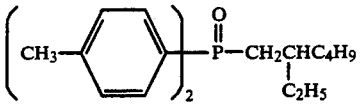

(TO-86) 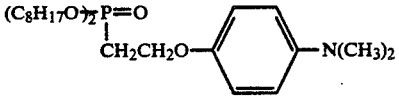

(TO-87) $(CH_3COOCH_2CH_2OCH_2CH_2O)_2P{=}O{-}C_{18}H_{37}$ (TO-88) 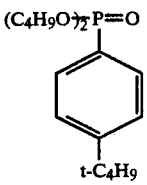

(TO-89) 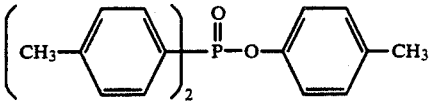

(TO-90) 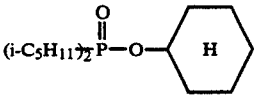

The using amount of the high-boiling organic solvent is preferably 0.1 to 10 ml, and more preferably 0.1 to 5 ml per gram of a coupler.

Other high-boiling organic solvents usable in combination with the above high-boiling organic solvent are those nonreactive with the oxidation product of a developing agent and having a boiling point of not lower than 150° C., such as phenol derivatives, phthalates, phosphates, citrates, maleates, alkylamides, fatty acid esters and trimesic acid esters.

Where the light-sensitive material of the invention is a multicolor photographic light-sensitive material, an acylacetanilide-type yellow coupler and a phenol or naphthol-type cyan coupler may be used.

Arrangement of the silver halide emulsion layers of the light-sensitive material is made preferably in the order from the support side of an yellow coupler-containing blue-sensitive silver halide emulsion layer, a magenta coupler-containing green-sensitive silver halide emulsion layer and a cyan coupler-containing red-sensitive silver halide emulsion layer. The entire construction of the light-sensitive material preferably comprises a support and, provided thereon in order from the support side, a blue-sensitive silver halide emulsion layer containing a yellow coupler, a green-sensitive silver halide emulsion layer containing a compound of Formula T and a magenta coupler of Formula M-I, a non-light-sensitive intermediate layer containing an ultraviolet absorbing agent, a red-sensitive silver halide emulsion layer containing a cyan coupler, a non-light-sensitive layer containing an ultraviolet absorbing layer, and a protective layer. The above-mentioned support is preferably a resin-coated paper support or a white pigment-containing polyethylene terephthalate support.

The aforementioned ultraviolet absorbing agent is preferably one having the following Formula U:

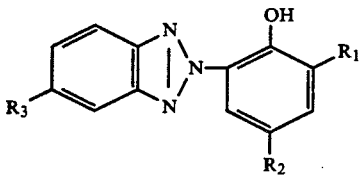

Formula U

In Formula U, $R_1$, $R_2$ and $R_3$ each represents a hydrogen atom, a halogen atom, an alkyl group, an aryl group, an alkoxy group, an aryloxy group, an alkenyl group, a nitro group or a hydroxyl group.

These groups represented by $R_1$ to $R_3$ include those having a substituent.

Of the groups represented by $R_1$ and $R_3$ preferred are the hydrogen atom, alkyl group, alkoxy group and aryl group, and more preferred are the hydrogen atom, alkyl group and alkoxy group.

Of the groups represented by $R_3$, particularly preferred are the hydrogen atom, halogen atom, alkyl group and alkoxy group.

At least one of $R_1$ to $R_3$ is preferably an alkyl group, and further at least two of $R_1$ to $R_3$ are preferably alkyl groups. Also, at least one of $R_1$ to $R_3$ is preferably a branched alkyl group.

The following are typical examples of the compound having Formula U.

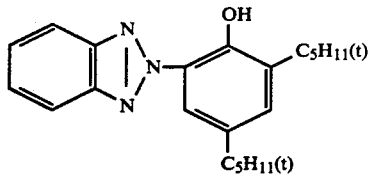

U-1

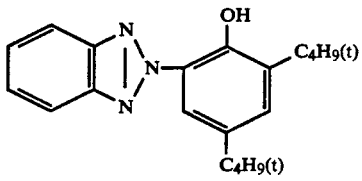

U-2

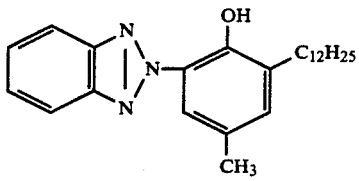

U-3

-continued

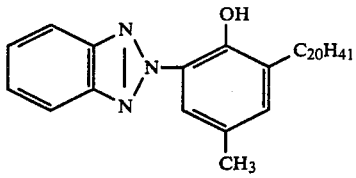

U-4

The adding amount of these compounds having Formula U is preferably 0.1 to 300% by weight, and more preferably 1 to 200% by weight of the binder contained in the layer to which the compound is added.

The silver halide of the silver halide photographic light-sensitive material of the invention may be any arbitrary one for use in conventional silver halide emulsions, such as silver bromide, silver iodobromide, silver iodochloride, silver chlorobromide or silver chloride. Particularly, the silver halide is preferably one that contains not less than 90 mole % silver chloride, not more than 10 mole % silver bromide and not more than 0.5 mole % silver iodide, and more preferably silver chlorobromide containing 0.1 to 5 mole % silver bromide.

The silver halide grains of the invention may be used alone or in a mixture with other silver halide grains of a different composition, and may also be used in a mixture with silver halide grains containing not more than 10 mole % silver chloride.

In the silver halide emulsion layer containing silver halide grains having a silver chloride content of not less than 90 mole %, the amount of the not less than 90 mole % silver chloride content silver halide grains accounts for 60% by weight or more, and more preferably 80% by weight or more of the whole silver halide grains contained in the emulsion layer.

The silver halide grain of the invention may have either a uniform composition from the inner part through the outer part thereof or a difference in composition between the inner part and the outer part thereof. If there is a defference in composition between the inner part and the outer part of the grain, the composition may vary continuously or discontinuously.

The grain diameter of the silver halide grain usable in the light-sensitive material of the invention, although not particularly restricted, is preferably 0.2 to 1.6μm. and more preferably 0.2% to 1.2μm, taking into account the rapid-processability, sensitivity and other photographic characteristics.

The above grain diameter can be measured by various methods generally used by those in the art: typical methods are described in Loveland, the 'Methods for Analyzing Grain Diameters' (A.S.T.M. Symposium on Light Microscopy, 1955 pp.94–122) and Mees and James, Chapter 2 of 'The Theory of Photographic Process' 3rd Ed., McMillan (1966).

The grain diameter can be measured by using either the projection area of the grain or an approximate value of the diameter of the grain. Where the grains are of a substantially uniform configuration, the grain diameter distribution thereof can be fairly accurately expressed in terms of the grain diameter or projection area.

The silver halide of the invention may have a wide or narrow grain diameter distribution, i.e., may be either polydisperse or monodisperse. However, the silver halide grains are preferably monodisperse silver halide grains having, in the grain diameter distribution thereof, a coefficient of variation of not more than 0.22, and more preferably not more than 0.15. The coefficient of variation herein is a coefficient representing the width of the grain diameter distribution, which is defined by the following equation:

$$\text{Coefficient of variation } (S/r) = \frac{\text{Standard deviation of grain size distribution}}{\text{Average grain size}}$$

$$\text{Standard deviation of grain size distribution } (S) = \sqrt{\frac{\Sigma(r - ri)^2 ni}{\Sigma ni}}$$

$$\text{Average grain size } (r) = \frac{\Sigma niri}{\Sigma ni}$$

wherein ri represents the grain diameter of each grain, and ni represents the number of the grains.

The grain diameter herein, in the case of a spherical silver halide grain, is its diameter. while in the case of a cubic or nonspherical grain, is the diameter of a circular image equivalent in the area to its projection image.

The silver halide grain used in the emulsion usable in the invention may be prepared by any one of acidic, neutral and ammoniacal methods. The grain may be grown at a time or, after making a seed grain, may be grown from the seed grain. The method for making a seed grain and the method for growing the grain therefrom may be either the same or different.

The reaction of a water-soluble silver salt with a water-soluble halide may be carried out by a normal precipitation method, a reverse precipitation method, a double-jet precipitation method or a method in combination of these methods, but is performed preferably by the double-jet precipitation method. Further, as a version of the double-jet precipitation method, the pAg-controlled double jet method described in Japanese patent O.P.I. Publication No. 48521/1979 may be used.

If necessary, a silver halide solvent such as thioether may be used. In addition, a mercapto group-containing organic compound, a nitrogen-containing heterocyclic compound or compounds such as sensitizing dyes may be added in the course of or upon completion of the formation of the silver halide.

The silver halide grain relating to the invention may be of an arbitrary configuration. A preferred example of the configuration is a cube having a {100} face as a crystal face. The silver halide grain may also have an octahedral. tetradecahedral or dodecahedral configuration, which may be prepared in accordance with those methods described in U.S. Patent Nos. 4,183,756 and 4,225,666; Japanese Patent O.P.I. Publication No. 26589/1980; Japanese Patent Examined Publication No. 42737/1980; and the Journal of Photographic Science, 21, 39 (1973). Further, twin plane-having grains may also be used in the invention.

The silver halide grains may be either an aggregate of grains of a uniform configuration or a mixture of grains of varied configurations.

The silver halide grain may contain metallic ions in the inside and/or the surface thereof by adding thereto, in the course of the formation and/or growth thereof, a cadmium salt, a zinc salt, a lead salt, a thalium salt, an iridium salt or complex salt, a rhodium salt or complex salt, or an iron salt or complex salt, and may have a reduction sensitization speck in the inside and/or surface thereof by being placed in an appropriate reductive atmosphere.

An emulsion containing the silver halide grain may. after completion of the growth of the silver halide grain, have the useless water-soluble salts removed therefrom or remain unremoved. Where the salts are to be removed, the removal may be performed in accordance with the method described in Research Disclosure 17643.

The silver halide grain used in the emulsion may be either one forming a latent image mainly on the surface thereof or one forming it mainly in the inside thereof, but is preferably the former.

The emulsion is chemically sensitized in the usual manner.

The light-sensitive material of the invention can provide a dye image by being imagewise exposed and then processed in the procedure including at least a color developing process and a desilvering process, and preferably in the procedure comprising exposure, color developing, bleach-fix and washing or stabilization processes.

In the color developing process. a color developer solution containing a color developing agent is usually used. The process, however, includes the processing of a color photographic light-sensitive material containing a part or the whole of the necessary amount of a color developing agent in a color developer solution containing or not containing a color developing agent.

The color developing agent contained in a color developer solution is an aromatic primary amine color developing agent which includes aminophenol-type and p-phenylenediamine-type derivatives, and is preferably a p-phenylenediamine-type derivative. These color developing agents may be used in the form of organic and inorganic acid salts such as a hydrochlorid. a sulfate, a p-toluenesulfonate, a sulfite, an oxalate and benzenesulfonate.

These compounds may be used in an amount of normally about 0.1 to 30 g, and preferably about 1 to 15 g per liter of a color developer solution.

Useful aromatic primary amine color developing agents are N,N-dialkyl-p-phenylenediamine-type compounds of which the alkyl and phenyl groups may or may not have a substituent. Among them, particularly useful compound examples are N,N-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)-toluene, N-ethyl-N-β-methanesulfonamidoethyl-3-methyl-4-aminoaniline sulfate. N-ethyl-N-β-hydroxyethylaminoaniline, 4-amino-3-methyl-N,N-di-ethylaniline and 4-amino-N-(2-methoxyethyl)-N-ethyl-3-methylaniline-p-toluene sulfonate.

The above color developing agents may be used alone or in combination. The color developer solution may contain alkali agents generally used such as sodium hydroxide. potassium hydroxide, ammonium hydroxide, sodium carbonate, potassium carbonate, sodium phosphate, sodium metaborate and borax. Further. the developer may contain various additives including a alkali metal halide such as potassium bromide or potassium chloride: a development control agent such as citrazinic acid: a preservative such as hydroxylamine, polyethyleneimine or grape sugar: and a sulfate such as sodium sulfite or potassium sulfite. In addition, the developer may also contain a deforming agent, a surface active agent, methanol, N,N-dimethylformamide, ethylene glycol, diethylene glycol, dimethylsulfoxide, benzyl alcohol, or the like. In the invention, however, it is preferable to process the light-sensitive material in a color developer substantially not containing benzyl alcohol but contain a sulfite in an amount of $2\times10^{-2}$ mole, more preferably $1\times10^{-4}$ to $1.7\times10^{-2}$ mole and most preferably $5\times10^{-3}$ to $1\times10^{-2}$ mole per liter. The above substantially not containing benzyl alcohol means that the benzyl alcohol's concentration is less than 0.5 ml per liter, and is preferably zero.

The color developer solution generally has a pH of not less than 7, and preferably about 9 to 13.

Processing in the color developer solution is made at a temperature of 10° C. to 65° C., and preferably 25° C. to 45° C. and for a period of time of within 2 minutes and 30 seconds, and preferably within 2 minutes.

After color developing, the silver halide color light-sensitive material is usually subjected to bleaching. The bleaching may be performed either simultaneously with fixing (bleach-fix) or separately from fixing, but the use of a bleach-fix bath for making bleaching and fixing in a single bath is preferred. The pH of the bleach-fix bath is preferably 4.5 to 6.8, and more preferably 4.5 to 6.0.

The bleacing agent for the bleach-fix bath is preferably a metal complex salt of an organic acid, particularly, such as aminopolycarboxylic acid, oxalic acid or citric acid, coordinated with a metallic ion such as of iron, cobalt or copper.

Additives to the bleach-fix bath include rehalogenating agents such as potassium bromide, sodium bromide, sodium chloride and ammonium bromide; other metallic salts; and chelating agents.

Conventionally known additives for ordinary bleaching baths may also be used which include pH buffers such as a borate, an oxalate, an acetate, a carbonate and a phosphate; alkylamines, and polyethylene oxides.

Further, the bleach-fix bath may contain sulfites such as ammonium sulfite, potassium sulfite, ammonium bisulfite, potassium bisulfite, sodium bisulfite, ammonium metabisulfite, potassium metabisulfite and sodium metabisulfite; and a single or combination of two or more of pH buffers including boric acid, borax, sodium hydroxide, potassium hydroxide, sodium carbonate, potassium carbonate, sodium bicarbonate, potassium bicarbonate, acetic acid, sodium acetate and ammonium hydroxide.

EXAMPLES

Example 1

A solution of couplers, a dye image stabilizer and an antistain agent dissolved in a high-boiling solvent and ethyl acetate was added to an aqueous gelatin solution containing a dispersing assistant, and then dispersed by a supersonic homogenizer. To the obtained dispersion were added a gelatin solution for coating and a light-sensitive silver halide emulsion, whereby an emulsion coating liquid was prepared.

The componetn layers given in Table-1 were coated on the titanium oxide-containing polyethylene-laminated side of a paper support the other side of which was laminated with polyethylene, whereby a multilayer silver halide color photographic light-sensitive material Sample 1 was prepared.

The silver halide emulsion used in the above were prepared in the following manner:

Preparation of blue-sensitive silver halide emulsion

To 1000 ml of an aqueous 2% gelatin solution kept at 40° C. were added simultaneously spending about 30 minutes the following solutions A and B with pAg and pH being controlled at 6.5 and 3.0, respectively, and further added simultaneously spending 180 minutes the following solutions C and D with pAg and pH being controlled at 7.3 and 5.5, respectively.

In this instance, the control of pAg was made in accordance with the method disclosed in Japanese O.P.I. Publication No. 45437/1984, and the control of pH was made with an aqueous solution of sulfuric acid or sodium hydroxide.

| | |
|---|---|
| Solution A | |
| NaCl | 3.42 g |
| KBr | 0.03 g |
| Water to make | 200 ml |
| Solution B | |
| $AgNO_3$ | 10 g |
| Water to make | 200 ml |
| Solution C | |
| NaCl | 102.7 g |
| KBr | 1.0 g |
| Water to make | 600 ml |
| Solution D | |
| $AgNO_3$ | 300 g |
| Water to make | 600 ml |

After completion of the addition, the emulsion was desalted by flocculation using an aqueous 5% solution of Demol N, produced by Kawo Atlas Co., and an aqueous 20% magnesium sulfate solution, and the emulsion was mixed with an aqueous gelatin solution to thereby obtain a monodisperse cubic silver halide Emulsion EMP-1 having an average grain diameter of 0.85 μm, a coefficient of variation ($S/\bar{r}$) of 0.07 and a silver chloride content of 99.5 mole %.

The above Emulsion EMP-1, after adding the following compounds thereto, was chemically ripened at 50° C. for 90 minutes, whereby a blue-sensitive silver halide Emulsion Em A was prepared.

| | |
|---|---|
| Sodium thiosulfate | 0.8 mg per mol of AgX |
| Chloroauric acid | 0.5 mg per mol of AgX |
| Stabilizer SB-5 | $6\times10^{-4}$ mol per mol of AgX |
| Sensitizing dye D-1 | $5\times10^{-4}$ mol per mol of AgX |

Preparation of green-sensitive silver halide emulsion

A monodisperse cubic silver halide Emulsion EMP-2 having an average grain diameter of 0.43 μm, a coefficient of variation ($S/\bar{r}$) of 0.08 and a silver chloride content of 99.5 mole % was prepared in the same manner as in EMP-1 except that the adding time of Solutions A and B and that of Solutions C and D were changed.

Emulsion EMP-2, after adding the following compound thereto, was chemically ripened at 55° C. for 120 minutes, whereby a green-sensitive silver halide Emulsion EM B was prepared.

| | |
|---|---|
| Sodium thiosulfate | 1.5 mg per mol of AgX |
| Chloroauric acid | 1.0 mg per mol of AgX |
| Stabilizer SB-5 | $6\times10^{-4}$ mol per mol of AgX |
| Sensitizing dye D-2 | $4.0\times10^{-4}$ mol per mol of AgX |

Preparation of red-sensitive silver halide emulsion

A monodisperse cubic silver halide Emulsion EMP-3 having an average grain diameter of 0.50 μm, a coefficient of variation ($S/\bar{r}$) of 0.08 and a silver chloride content of 99.5 mole % was prepared in the same manenr as in EMP-1 except that the adding time of Solutions A and B and that of Solutions C and D were changed.

EMP-3, after adding the following compounds thereto, was chemically ripened at 60° C. for 90 minutes, whereby a red-sensitive silver halide Emulsion EM C was prepared.

| | |
|---|---|
| Sodium thiosulfate | 1.8 mg per mol of AgX |
| Chloroauric acid | 2.0 mg per mol of AgX |
| Stabilizer SB-5 | $6 \times 10^{-4}$ mol per mol of AgX |
| Sensitizing dye D-3 | $8.0 \times 10^{-4}$ mol per mol of AgX |

D-1

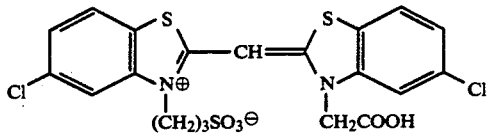

D-2

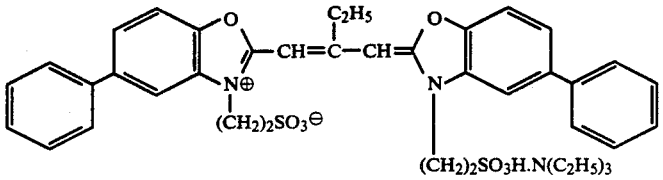

D-3

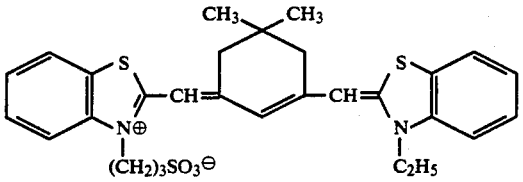

SB-5

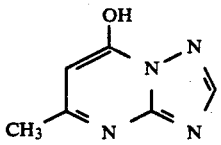

TABLE-1

| Layer | Component | Added amt ($g/m^2$) |
|---|---|---|
| Layer 7 (protective layer) | Gelatin | 1.0 |
| Layer 6 (Ultraviolet absorbing layer) | Gelatin | 0.6 |
| | Ultraviolet absorbing agent UV-1 | 0.2 |
| | Ultraviolet absorbing agent UV-2 | 0.2 |
| | Anti-color-mixing agent HQ-1 | 0.01 |
| | S-5 | 0.2 |
| | PVP | 0.03 |
| | Antiirradiation dye AI-2 | 0.02 |
| Layer 5 (Red-sensitive layer) | Gelatin | 1.40 |
| | Red-sensitive silver chlorobromide emulsion Em C, in terms of silver | 0.24 |
| | Cyan coupler C-1 | 0.17 |
| | Cyan coupler C-2 | 0.25 |
| | Dye image stabilizer ST-1 | 0.20 |
| | HB-1 | 0.10 |
| | Antistain agent HQ-1 | 0.01 |
| | S-2 | 0.30 |
| Layer 4 (Ultraviolet absorbing layer) | Gelatin | 1.30 |
| | UV-1 | 0.40 |
| | UV-2 | 0.40 |
| | HQ-1 | 0.03 |
| | S-5 | 0.40 |
| Layer 3 (Green-sensitive | Gelatin | 1.40 |
| | Green-sensitive silver chlorobromide emulsion Em B, in terms of silver | 0.27 |
| | Magenta coupler M-A | 0.35 |
| | Additive AO-1 | 0.20 |
| | S-2 | 0.30 |
| | Antiirradiation Dye AI-1 | 0.01 |
| Layer 2 (Interlayer) | Gelatin | 1.20 |
| | Anti-color-mixing agent HQ-1 | 0.12 |

TABLE-1-continued
| | | |
|---|---|---|
| | S-7 | 0.15 |
| Layer 1 (Blue-sensitive layer) | Gelatin | 1.30 |
| | Blue-sensitive silver chlorobromide emulsion Em A, in terms of silver | 0.30 |
| | Yellow coupler Y-1 | 0.80 |
| | Dye image stabilizer ST-1 | 0.30 |
| | Dye image stabilizer ST-2 | 0.20 |
| | Antistain agent HQ-1 | 0.02 |
| | S-5 | 0.20 |
| Support | Polyethylene-laminated paper | |
Y-1
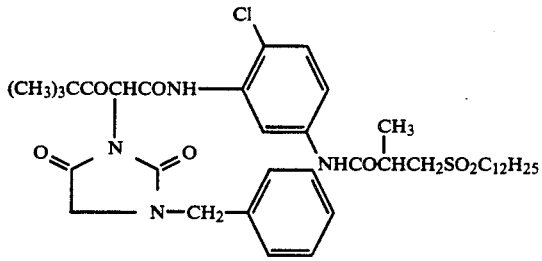
M-A
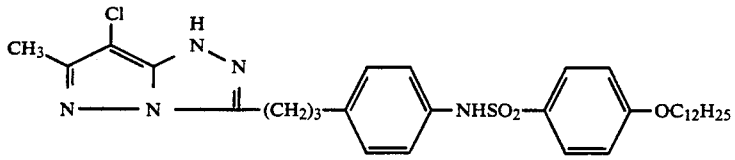
C-1
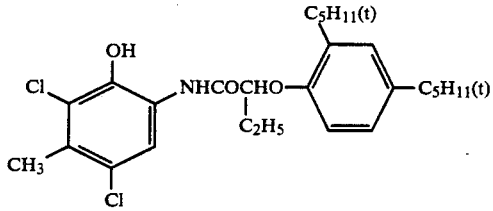
C-2
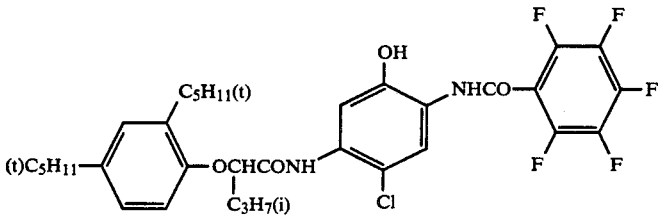
ST-1
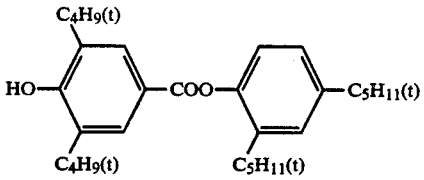
ST-2
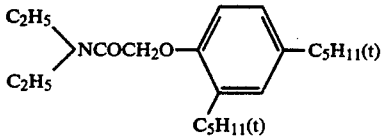
PVP Polyvinylpyrrolidone
UV-1
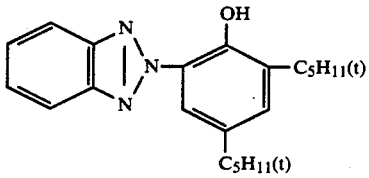

TABLE-1-continued

UV-2

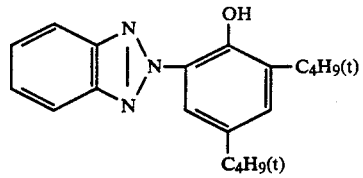

HQ-1

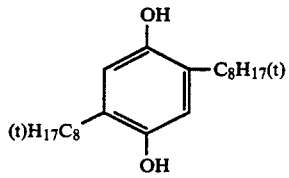

AO-1

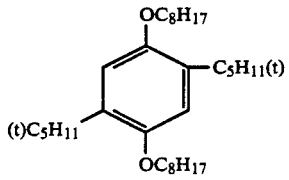

AI-1

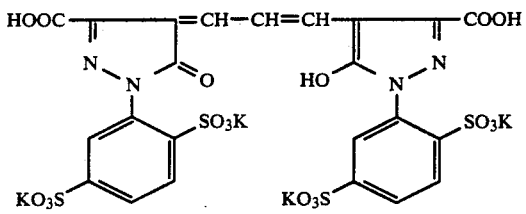

AI-2

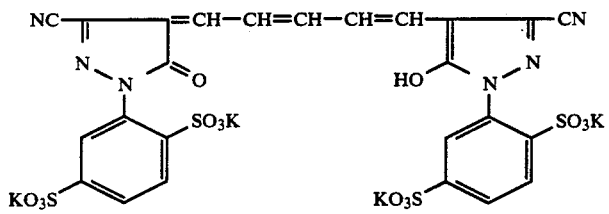

HB-1

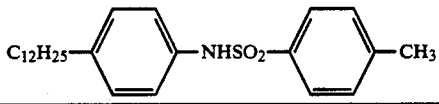

Next, multilayer light-sensitive material samples were prepared in the same manner as in Sample 1 except that the combination of the magenta coupler and the dye image stabilizer of Layer 3 of Sample 1 were replaced by the combinations of those given in Table 2.

Each sample was exposed through an optical wedge to a green light in the usual manner, and then processed in accordance with the following steps:

| Processing steps | Temperature | Time |
|---|---|---|
| Color developing | 35.0 ± 0.3° C. | 45 seconds |
| Bleach-fix | 35.0 ± 0.5° C. | 45 seconds |
| Stabilizing | 30 to 34° C. | 90 seconds |
| Drying | 60 to 80° C. | 60 seconds |

Developer

| | |
|---|---|
| Pure water | 800 ml |
| Triethanolamine | 10 g |
| N,N-diethylhydroxylamine | 5 g |
| Potassium bromide | 0.02 g |
| Potassium chloride | 2 g |
| Potassium sulfite | 0.3 g |
| 1-Hydroxyethylidene-1,1-diphosphonic acid | 1.0 g |

-continued

| | |
|---|---|
| Ethylenediaminetetraacetic acid | 1.0 g |
| Disodium catechol-3,5-disulfonate | 1.0 g |
| N-ethyl-N-β-methanesulfonamidoethyl-3-methyl-4-aminoaniline sulfate | 4.5 g |
| Brightening agent (4,4'-diaminostilbene-sulfonic acid derivative) | 1.0 g |
| Potassium carbonate | 27 g |
| Water to make 1 liter. Adjust pH to 10.10. | |

Bleach-fix bath

| | |
|---|---|
| Ferric-ammonium ethylenediaminetetraacetate dihydrate | 60 g |
| Ethylenediaminetetraacetic acid | 3 g |
| Ammonium thiosulfate (70% solution) | 100 ml |
| Ammonium sulfite (40% solution) | 27.5 ml |
| Water to make 1 liter. Adjust pH to 5.7 with potassium carbonate or glacial acetic acid. | |

Stabilizer bath

| | |
|---|---|
| 5-Chloro-2-methyl-4-isothiazoline-3-one | 1.0 g |
| Ethylene glycol | 1.0 g |
| 1-Hydroxyethylidene-1,1-diphosphonic acid | 2.0 g |
| Ethylenediaminetetraacetic acid | 1.0 g |
| Ammonium hydroxide (20% solution) | 3.0 g |
| Ammonium sulfite | 3.0 g |
| Brightening agent (4,4'-diaminostilbene- | 1.5 g |

-continued

| |
|---|
| disulfonic acid derivative) |
| Water to make 1 liter. |
| Adjust pH to 7.5 with sulfuric acid or potassium hydroxide. |

All the processed samples having magenta dye images were evaluated as follows:

Light fastness test

The fading rate of the initial density of 1.0 was found of each sample when exposed for 14 days to the sunlight in an underglass outdoor sunlight exposure stand.

$$\text{Fading rate} = (1.0 - \textit{density after fading}) \times 100$$

In addition, the rate of increase in the blue light reflection density (stain) in the background white area was measured. The results are shown in Table-2.

As is apparent from Table-2, the combinations of the compounds of the invention and the couplers of Formula M-I has excellent synergistic effects on reducing the fading rate and stain.

Further, the excellent effect of the invention was obtained as well in other samples prepared with M-3, M-13 and M-28 in place of the magenta coupler of Sample 6; with an equivalent weight mixture of S-5 and TO-66 in place of the S-2 of Sample 12; and with TO-4 and TO-55 in place of ½ weight of the S-2 of Sample 13.

EXAMPLE 2

Samples were prepared in the same manner as in Sample 1 of Example 1 except that the magenta coupler, dye image stabilizer and high-boiling organic solvent in Lyaer 3 of Sample 1 were variously changed as given in Table 3, and the samples were subjected to the same light fastness test as in Example 1. The results are shown in Table 3.

TABLE-2

| Sample | Magenta coupler | Dye image stabilizer | | Light fastness | |
|---|---|---|---|---|---|
| | | Compound | Added amt* | Fading rate | Stain |
| 1 (Comparative) | M-A | — | — | 84 | 0.08 |
| 2 (Comparative) | " | ST-1 | 1.0 mol | 81 | 0.08 |
| 3 (Comparative) | " | T-9 | 1.0 mol | 77 | 0.08 |
| 4 (Comparative) | M-1 | — | — | 80 | 0.08 |
| 5 (Comparative) | " | ST-1 | 1.0 mol | 71 | 0.08 |
| 6 (Invention) | " | T-9 | 1.0 mol | 46 | 0.07 |
| 7 (Invention) | " | T-8 | 1.0 mol | 45 | 0.07 |
| 8 (Invention) | " | T-11 | 1.0 mol | 45 | 0.07 |
| 9 (Invention) | " | T-10 | 1.0 mol | 47 | 0.07 |
| 10 (Comparative) | M-14 | — | — | 79 | 0.08 |
| 11 (Comparative) | " | ST-1 | 1.0 mol | 68 | 0.07 |
| 12 (Invention) | " | T-9 | 1.0 mol | 32 | 0.06 |
| 13 (Invention) | " | T-8 | 1.0 mol | 31 | 0.06 |
| 14 (Invention) | " | T-11 | 1.0 mol | 31 | 0.06 |
| 15 (Invention) | " | T-10 | 1.0 mol | 31 | 0.06 |
| 16 (Invention) | " | T-24 | 1.0 mol | 29 | 0.06 |
| 17 (Invention) | " | T-25 | 1.0 mol | 30 | 0.06 |
| 18 (Invention) | " | T-22 | 1.0 mol | 30 | 0.06 |
| 19 (Comparative) | M-B | — | — | 85 | 0.41 |
| 20 (Comparative) | " | T-9 | 1.0 mol | 79 | 0.41 |

M-B

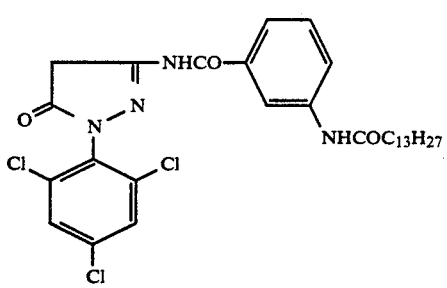

Added amount: Molar amount per mol of Coupler 1 in the same layer.

TABLE 3

| Sample No. | Magenta coupler | Dye image stabilizer | | HBS* | Light fastness | |
|---|---|---|---|---|---|---|
| | | Compound | Added amt | | Fading rate | stain |
| 1 (Comparative) | M-A | — | — | S-2 | 84 | 0.08 |
| 2 (Comparative) | " | T-9 | 1.0 mol | " | 77 | 0.08 |
| 10 (Comparative) | M-14 | — | — | " | 79 | 0.08 |
| 11 (Comparative) | " | ST-1 | 1.0 mol | " | 68 | 0.07 |
| 12 (Invention) | " | T-9 | " | " | 32 | 0.06 |
| 21 (Invention) | " | " | " | S-5 | 31 | 0.06 |
| 25 (Invention) | " | " | " | DBP** | 39 | 0.06 |
| 26 (Invention) | " | " | " | TCP*** | 41 | 0.06 |
| 27 (Invention) | " | " | " | S-12 | 37 | 0.06 |
| 20 (Comparative) | M-B | " | " | S-2 | 79 | 0.41 |
| 22 (Comparative) | " | T-24 | " | " | 79 | 0.41 |
| 23 (Comparative) | " | T-25 | " | " | 79 | 0.41 |

TABLE 3-continued

| Sample No. | Magenta coupler | Dye image stabilizer Compound | Dye image stabilizer Added amt | HBS* | Light fastness Fading rate | Light fastness stain |
|---|---|---|---|---|---|---|
| 24 (Comparative) | " | T-22 | " | " | 79 | 0.41 |

HBS: High-boiling organic solvent
DBP: Dibutyl phthalate
TCP: Tricresyl phosphate As is apparent from Table-3, the combinations of the compounds of the invention and the magenta couplers of Formula M-I remarkably improve the light fastness, and the improving effect is significant particularly when a high-boiling organic solvent having a dielectric constant of not more than 6.0 at 30° C. is used.

The excellent effect of the invention was obtained as well in other samples prepared with T-1, T-2, T-4, T-7, T-14, T-16 and T-17 in place of the T-9 of Sample 12; with T-11 in place of the T-9 of Sample 12; with TO-68 and TO-86 in place of ½ weight of the S-5 of Sample 21; and with T-20, T-29 and T-31 in place of Sample 22.

What is claimed is:

1. A silver halide photographic light-sensitive material comprising a support having thereon a green-sensitive silver halide emulsion layer containing a compound T represented by the following and a magenta coupler M-I represented by the following formulas:

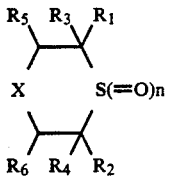

(T)

wherein each of $R_1$ and $R_2$ is a hydrogen atom or an alkyl group; each of $R_3$ and $R_4$ is a hydrogen atom, an alkyl group, an aryl grup, or a heterocyclic grup; each of $R_5$ and $R_6$ is a hydrogen atom, an alkyl group, an aryl grup, an acyl group, or an alkoxycarbonyl grup; X is a divalent group including a carbon atom as the component of the 6-member ring of formula T; and n is an integer of zero, 1 to 2; and

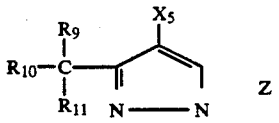

M-I wherein each of $R_9$ and $R_{10}$ is an alkyl grup, and $R_{11}$ is a hydrogen atom or a substituent; Z is a group of non-metal atoms necessary to form a nitrogen-containing heterocyclic ring; Xs is a hydrogen atom or a substituent capable of splitting off upon reaction with the oxidation product of a color developing agent.

2. The material of claim 1 wherein each of said $R_9$, $R_{10}$ and $R_{11}$ is an alkyl group.

3. The material of claim 1 wherein each of said $R_9$ and $R_{10}$ is an alkyl group and said $R_{11}$ is a hydrogen atom.

4. The material of claim 3 wherein said $R_9$ and $R_{10}$ are bonded to each other to form a cycloalkyl ring.

5. The material of claim 1, wherein said compound represented by formula T is contained in said silver halide emulsion layer in an amount of not more than 1.5 g per $m^2$.

6. The material of claim 5, wherein said compound represented by formula T is contained in said silver halide emulsion layer in an amount of from 0.01 g to 0.6 g per $m^2$.

7. The material of claim 1, wherein said magenta coupler is contained in said silver halide emulsion layer in an amount of from $1\times10^{-3}$ mol to 1 mol per mol of silver contained said silver halide emulsion layer.

8. The material of claim 1, wherein said magenta coupler is contained in said silver halide emulsion layer in an amount of from $1\times10^{-2}$ mol to $8\times10^{-1}$ mol per mol of silver contamined said silver halide emulsion layer.

9. The material of claim 1, wherein said silver halide emulsion layer contains a high-boiling organic solvent.

10. The material of claim 9, wherein said high-boiling solvent has a dielectric constant of not more than 6.0 at 30° C.

11. The material of claim 10, wherein said high-boiling solvent has a dielectric constant of from 1.9 to 6.0 at 30° C. and a vapor pressure of not more than 0.5 mmHg at 100° C.

12. The material of claim 9, wherein said high-boiling solvent is a compound represented by the following formula S-1, S-2 or TO-1:

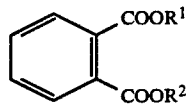

(S-1)

wherein $R^1$ and $R^2$ each is an alkyl grup, an alkenyl group or an aryl group provided that the total number of carbon atom contained in the groups represented by $R^1$ and $R^2$ is within the range of from 12 to 32;

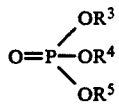

(S-2)

wherein $R^3$, $R^4$ and $R^5$ each is an alkyl group, an alkenyl group or an aryl group provided that the total number of carbon atoms contained in the groups represented by $R^3$, $R^4$ is with in the range of from 24 to 54;

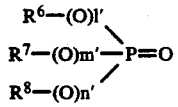

(TO-1)

wherein $R^6$, $R^7$ and $R^8$ each is an alkyl qroup or an aryl group; l', m' and n' each is zero or 1 provided that all of l', m' and n' are not 1 at the same time.

13. The material of claim 9, wherein said high-boiling solvent is contained in said silver halide emulsion layer in an amount of from 0.1 ml to 10 ml per gram of said magenta coupler.

14. The material of claim 13, wherein said high-boiling solvent is contained in said silver halide emulsion layer in an amount of from 0.1 ml to 5 ml per gram of said magenta coupler.

* * * * *